US006769331B2

(12) United States Patent
Berg et al.

(10) Patent No.: US 6,769,331 B2
(45) Date of Patent: Aug. 3, 2004

(54) MULTIPURPOSE TOOL INCLUDING FOLDING JAWS

(75) Inventors: Howard G. Berg, Gresham, OR (US); Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 10/223,830

(22) Filed: Aug. 19, 2002

(65) Prior Publication Data

US 2002/0189411 A1 Dec. 19, 2002

Related U.S. Application Data

(60) Continuation of application No. 09/839,377, filed on Apr. 20, 2001, now Pat. No. 6,450,071, which is a continuation of application No. 09/436,459, filed on Nov. 8, 1999, now Pat. No. 6,220,127, which is a continuation of application No. 09/066,282, filed on Apr. 24, 1998, now Pat. No. 5,979,959, which is a continuation of application No. 08/807,638, filed on Feb. 27, 1997, now Pat. No. 5,743,582, which is a division of application No. 08/563,922, filed on Nov. 29, 1995, now Pat. No. 5,745,997.

(51) Int. Cl.[7] ..... B25B 7/00

(52) U.S. Cl. ..... 81/427.5; 7/128; 7/168

(58) Field of Search ..... 81/427.5, 327–440, 81/177.4, 177.6, 490, 417; 7/167–168, 158, 127–135; 30/255, 261, 155, 159–161

(56) References Cited

U.S. PATENT DOCUMENTS

| | | | | |
|---|---|---|---|---|
| 70,718 | A | 11/1867 | Hoe | |
| 159,134 | A | 1/1875 | Woodward | 294/99.2 |
| 188,777 | A | 3/1877 | Chester | 7/128 |
| 239,208 | A | 3/1881 | Whitmore | 7/128 |
| 310,439 | A | 1/1885 | Kamak | |

(List continued on next page.)

FOREIGN PATENT DOCUMENTS

| | | |
|---|---|---|
| DE | 29556 | 4/1884 |
| DE | 145784 | 7/1902 |
| DE | 2322229 | 5/1974 |
| FR | 409943 | 5/1910 |
| IT | 521555 | 3/1995 |

OTHER PUBLICATIONS

Sports Tools (Xuron Corp.) FF–1 Stainless Steel Fishing Combination Cutter/Plier Tool, At least as early as 1993.

Slip 'n' Snip collapsible scissors, At least as early as Nov. 29, 1994.

Aitor pocket tool, At least as early as Nov. 29, 1994.

Folding Scissors, At least as early as Nov. 29, 1994.

SOG "Paratool" multipurpose tool, At least as early as 1993.

RCE Fish tail holder, At least as early as 1990.

Gerber Multi–plier multipurpose tool, At least as early as 1995.

Leatherman Tool Group, Inc.—"The Original Leatherman PST II", At least as early as Jul. 1995.

*Primary Examiner*—D. S. Meislin
(74) *Attorney, Agent, or Firm*—Chernoff, Vilhauer, McClung & Stenzel, LLP

(57) ABSTRACT

A multi-purpose folding tool including a pair of folding scissors, in which a scissors blade is movable about a pivot shaft, between a stowed position and a deployed position. A rocker is moved by a spring in the tool handle and urges a movable scissors blade toward an open position. In one embodiment two handles are folded about respective scissors blades to house the blades, and four springs hold the handles together with the folded scissors stowed within the handles. A pair of tweezers of sheet metal includes a pair of parallel arms each perpendicular to a base portion of the tweezers. When the scissors and other tools are folded into their stowed positions in the handle of the multi-purpose tool of the invention the tool has a smooth outside configuration allowing the tool to be carried in a pocket without causing undue wear.

28 Claims, 11 Drawing Sheets

U.S. PATENT DOCUMENTS

| | | | | | |
|---|---|---|---|---|---|
| 464,405 | A | | 12/1891 | Widmann | |
| 471,562 | A | | 3/1892 | Minnerly | |
| 515,828 | A | | 3/1894 | Hayden | |
| 533,504 | A | | 2/1895 | Sonnesen | 7/118 |
| 696,995 | A | | 4/1902 | Moser | |
| 716,623 | A | | 12/1902 | Brouillette | |
| 809,579 | A | | 1/1906 | Pastore | 294/99.2 |
| 1,046,361 | A | | 12/1912 | Wulff | 294/99.2 |
| 1,052,878 | A | | 2/1913 | Atkeson | 294/99.2 |
| 1,268,558 | A | | 6/1918 | Faix | |
| 1,467,661 | A | | 9/1923 | Undy | |
| 1,828,121 | A | | 10/1931 | Adam et al. | |
| 2,575,652 | A | | 11/1951 | Bovee | 81/43 |
| 2,601,766 | A | | 7/1952 | Riddell et al. | 294/99.2 |
| 2,847,889 | A | * | 8/1958 | Cain | 81/417 |
| 4,238,862 | A | * | 12/1980 | Leatherman | 7/128 |
| 4,888,869 | A | | 12/1989 | Leatherman | 30/161 |
| 5,142,721 | A | | 9/1992 | Sessions et al. | 7/128 |
| 5,212,844 | A | | 5/1993 | Sessions et al. | 7/128 |
| 5,400,451 | A | | 3/1995 | Furukawa | 7/106 |
| 5,743,582 | A | | 4/1998 | Rivera | 294/99.2 |
| 5,745,997 | A | | 5/1998 | Berg et al. | 30/155 |

* cited by examiner

MULTIPURPOSE TOOL INCLUDING FOLDING JAWS

This application is a continuation of U.S. patent application Ser. No. 09/839,377, filed Apr. 20, 2001, now U.S. Pat. No. 6,450,07 which is a continuation of U.S. patent application Ser. No. 09/436,459, filed Nov. 8, 1999, now U.S. Pat. No. 6,220,127, which is a continuation of U.S. patent application Ser. No. 09/066,282, filed Apr. 24, 1998, now U.S. Pat. No. 5,979,959, which is a continuation of U.S. patent application Ser. No. 08/807,638, filed Feb. 27, 1997, now U.S. Pat. No. 5,743,582, which is a division of U.S. patent application Ser. No. 08/563,922, filed Nov. 29, 1995, now U.S. Pat. No. 5,745,997.

BACKGROUND OF THE INVENTION

The present invention relates to multi-purpose folding tools, and in particular to folding scissors incorporated in such tools.

Folding scissors of various types have been known for many years and have long been included in multi-purpose folding tools. In the past, most folding scissors in such multi-purpose tools have been very small, and therefore relatively ineffective.

One type of folding scissors in a multi-purpose tool is disclosed, for example, in Moser U.S. Pat. No. 696,995. In that type of tool one blade of a pair of scissors has an extended handle which is attached to pivot the entire pair of scissors into a storage slot in a knife handle. A second handle and its attached scissors blade are also stowed in the same slot, with the scissors blades and handles generally parallel with one another. A small leaf spring is typically used to urge the handles apart from each other to open the blades of such a pair of miniature scissors, and the spring is kept compressed when the scissors are in the stowed position. The spring typically used in such scissors is easily lost or bent accidentally to an inoperative condition.

East German Patent Publication 2,322,229 discloses another type of folding scissors using a long spring in a handle of a tool to move an auxiliary lever to urge a movable scissors handle toward a blade-opening position. This arrangement, however, fails to hold the main scissors handle stably fixed relative to the tool handle when the movable scissors handle and blade are urged in a blade-closing direction with respect to the main blade.

German Patent No. 145784 discloses a tool incorporating a folding handle with a pair of scissors blades which can be stowed within a multi-purpose tool handle, but such scissors include the previously mentioned type of spring or none at all.

In previously known folding scissors including a spring for opening the scissors blades, the force needed to move the blades in a closing or cutting direction has increased with continued closing movement of the blades. It is therefore desired to provide scissors which are easier to use in that the force needed to close the blades completely is not greatly increased over that required to close the blades partially during a cutting stroke of the scissors.

What is needed, then, is an improved multi-purpose folding tool including folding scissors which are easily used, which provides ample leverage through handles of adequate length, which are easily stowed within the handle of the multi-purpose folding tool, and which do not interfere with the utility of other folding tool bits included in the multi-purpose folding tool. It is also desired for such folding scissors to be larger than previously available folding scissors included in a multi-purpose folding tool of a comparable size, and that the entire tool in a folded configuration can be easily carried in a person's pocket without causing unnecessary wear of the fabric of the pocket.

SUMMARY OF THE INVENTION

The present invention provides a multi-purpose folding tool which overcomes the previously-mentioned shortcomings and disadvantages of previously known folding tools by providing improved folding scissors and other tools having pivotally interconnected jaws or the like.

In one embodiment of the present invention a channel-shaped folding handle is attached to each of a pair of interconnected movable members such as the blades of a pair of scissors and a pair of springs in each handle operate, respectively, on the attached member such as a scissors blade and an adjacent rocker. Both springs in each handle operate to hold the handles together with the multi-purpose tool in a folded configuration. With the scissors, for example, ready for use, one spring in each handle holds the attached scissors blade securely aligned with the handle, while the other spring operates the associated rocker to urge the scissors blades toward an open position after each cutting stroke. Each rocker is linked with the adjacent scissors blade so that the rocker is free to pivot through a small angle relative to the blade but is moved along with the blade between the stowed position and the deployed position of the blade.

In a preferred embodiment of the invention, additional folding tool bits are included in the handles, mounted on tool pivot shafts spaced apart in the handles from the location of the scissors blades. When such tool bits are used, the handles are prevented from moving laterally with respect to each other by an ear on one of the springs in each handle and by a portion of each rocker extending alongside the scissors blade associated with the other handle.

In one embodiment of the invention a lanyard-attachment ear mounted on a pivot shaft may be extended for use or folded into a stored position where it is not likely to wear the fabric of a pocket in which the tool is carried.

In another preferred embodiment of the invention a pair of folding scissors is movable around a pivot shaft, between a stowed position in a handle of a multi-purpose folding tool and a deployed position in which the folding scissors extends with a first scissors blade held in a fixed position with respect to the handle of the multi-purpose tool. A second scissors blade is pivoted with respect to the first, while an operating lever is pivoted with respect to both of the blades and can engage the movable blade to move the blades toward a closed position in a cutting stroke of the scissors.

A rocker is mounted to pivot about the same shaft on which the main scissors blade is mounted and is pushed by a leaf spring also used to hold a selected one of the several tool bits of the multi-purpose tool. The rocker includes an outer end which pushes against a base portion of the movable second scissors blade to urge the blades toward an open position during use of the scissors. A single spring included in the handle of the multi-purpose tool thus operates to hold the main blade in position with respect to the handle and also to operate the rocker which moves the second scissors blade toward an open position during operation of the scissors according to the invention.

In one embodiment of the invention the operating lever nests alongside the scissors blades in the stowed position of the folding scissors, but is easily lifted into a position in which a portion of its base operates as a cam to move the scissors from their stowed position toward the deployed position.

In another embodiment of the invention, adjacent blades are engaged by tapered tips of adjacent springs each engaging only a particular one of the adjacent blades.

In other embodiments of the invention, pliers or other tools may include jaws or jawlike members pivotally interconnected with each other and arranged to be folded and stowed in tool handles in a manner similar to that in which the scissors blades operate and are interrelated with the tool handles.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
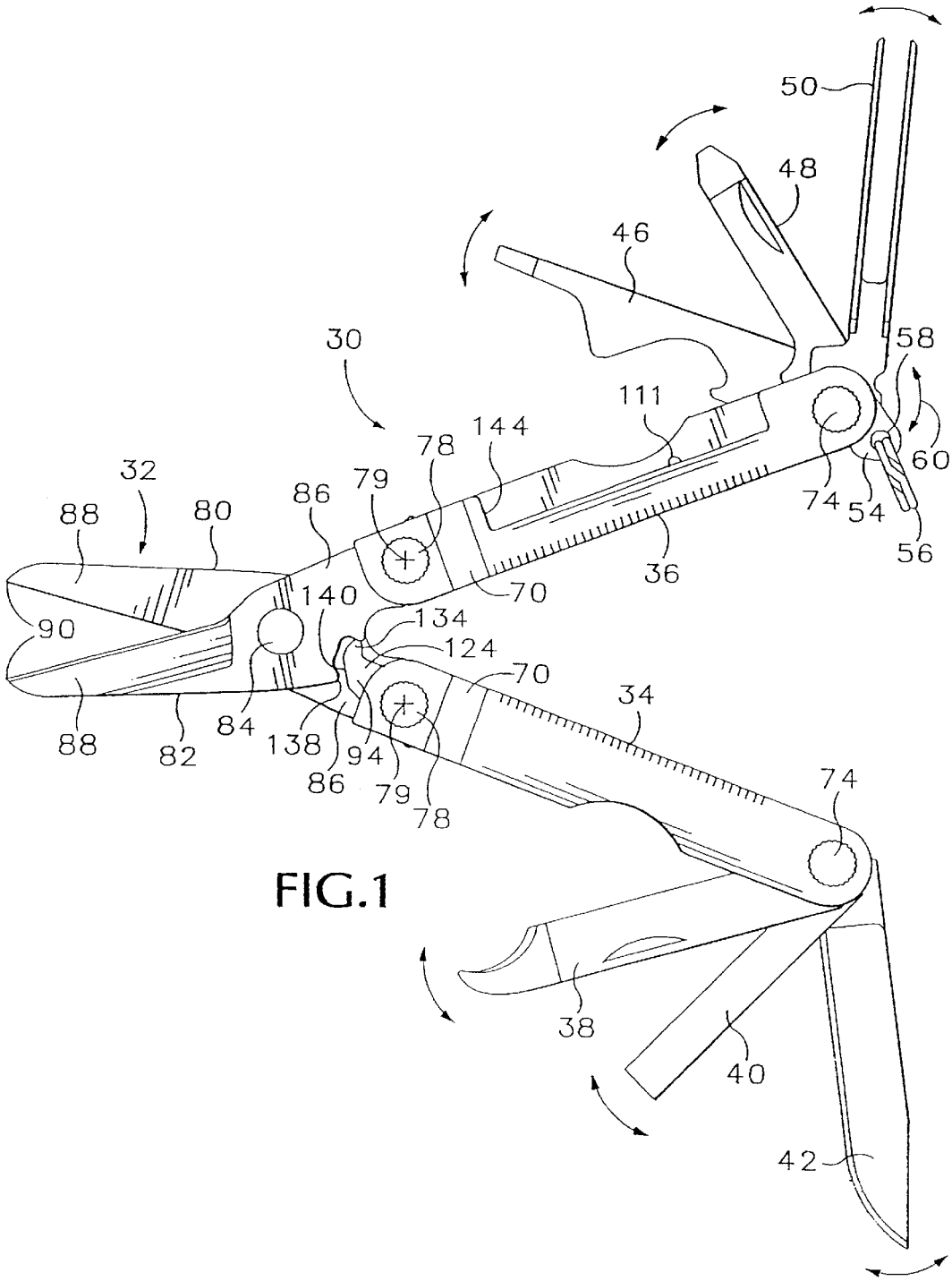
FIG. 1 is an elevational view of a multi-purpose folding tool which is an embodiment of the present invention.
Figure 2:
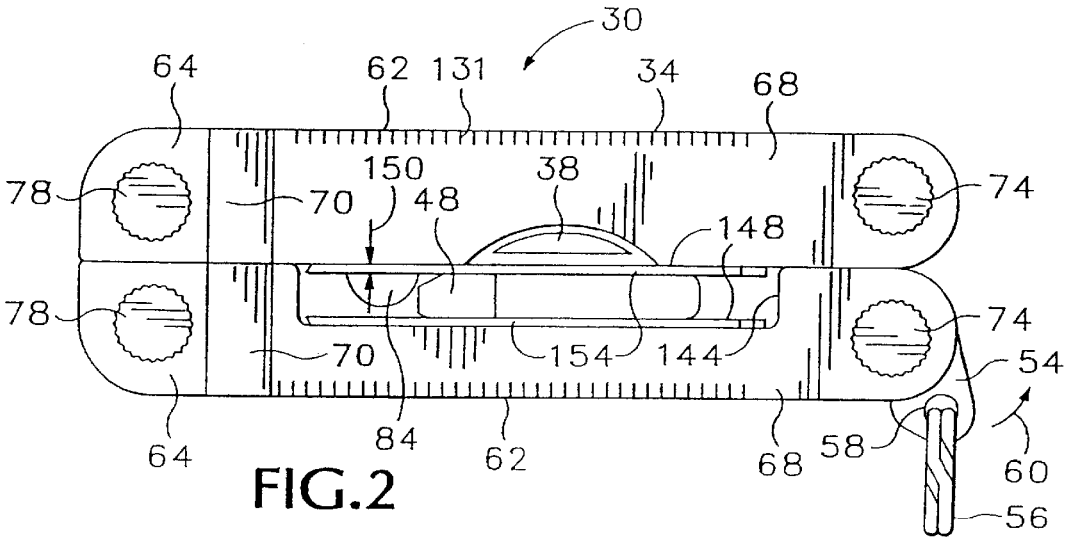
FIG. 2 is a left side view of the tool shown in FIG. 1, in a folded configuration.

Referring now to FIGS. 1–13 of the drawings which form a part of the disclosure herein, a folding multi-purpose tool 30 includes a pair of folding scissors 32 which can be received within a pair of handles 34 and 36 when the tool 30 is in a folded configuration as shown in FIGS. 2–7. Additional tool bits, such as a nail file 38, a medium screwdriver 40, and a knife blade 42, may be stowed within a cavity 44 defined within the first handle 34, and a combined small screwdriver and cap lifter 46, a flat Phillips screwdriver 48, and a pair of tweezers 50 may be stowed within a cavity 52 defined within the second handle 36. The just-mentioned additional tools may each be extended to a position parallel with the respective handle 34 or 36 for use. A lanyard attachment ear 54 is attached to the second handle 36, and a split ring 56 or other suitable fastening device may be engaged in a hole 58 defined in the lanyard receiving ear 54. The lanyard receiving ear 54 is movable in the direction indicated by the arrow 60, as will be discussed in greater detail subsequently.

Figure 5:
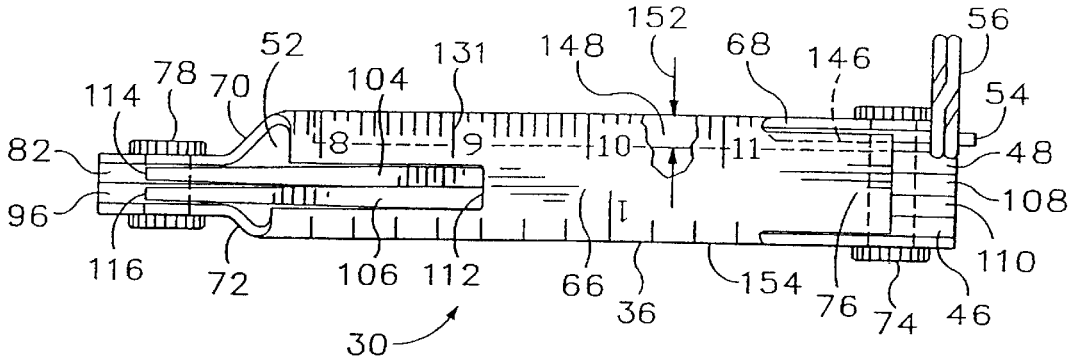
FIG. 5 is a bottom view of the tool shown in FIG. 1, in the folded configuration shown in FIG. 2.

Each of the handles 34 and 36 includes a wide portion 62 and a narrow scissors-end portion 64, formed appropriately of stainless steel sheet generally in the form of a channel including a bottom portion 66 (see FIG. 5). Respective side walls 68 extend generally perpendicularly away from the bottom 66 and parallel with each other except in tapering portions 70 and 72.

A tool pivot shaft 74, which may be a tubular internally threaded screw fastener with a mating externally threaded counterpart, is located in the wide portion 62 of each of the handles 34 and 36, extending transversely between the side walls 68 at a tool bit end of each handle. During assembly of the tool 30 the tool pivot shafts 74 are adjusted to provide sufficient tension to ensure a snug fit between the sidewalls 68 for the members rotating thereon, yet permit smooth movement, and are then held in the required position by an adhesive. The tool pivot shafts 74 act as fulcrums for each of the tool bits such as the knife blade 42 and tweezers 50. A leaf spring 76 is a cantilevered extension of the bottom 66 and bears upon the base portion of each of the folding tool bits to hold them selectively in an extended position, parallel with the respective handle 34 or 36 and ready for use.

At the scissors-end portion 64 of each handle, a respective scissors pivot pin 78, which may also be called a jaw pivot pin, is a fastener similar to the tool pivot shaft 74, but shorter.

The folding scissors 32 included in the folding tool 30 include a pair of blades, a first scissors blade 80 and a second scissors blade 82, which pivot with respect to each other about a scissors pivot joint 84 defined, for example, by a fastener such as a countersunk rivet interconnecting the two scissors blades 80 and 82. First and second scissors blades 80 and 82 are identical with each other, but are given different reference numbers here to facilitate understanding of their interaction with each other. Each of the blades 80 and 82 includes a respective base portion 86 extending from the scissors pivot joint 84 toward the respective handle 34 or 36 with which the particular blade is interconnected. A cutting portion 88 of each blade extends away from the scissors pivot joint 84 and culminates in a blade tip 90. The base portion 86 of each of the scissors blades 80 and 82 includes an aperture 92 that fits snugly around a respective one of the scissors pivot pins 78 in handle pivots which define respective handle pivot axes 79 about which each base portion 86 rotates with respect to the respective handle 34 or 36.

Each of a pair of identical rockers 94 and 96 includes an aperture 98 which also fits around a respective scissors pivot pin 78, permitting each of the rockers 94, 96 to pivot smoothly about the respective scissors pivot pin 78 which thus defines a respective rocker pivot axis coinciding with the handle pivot axis 79. The rocker 94 is thus associated with and located alongside the first scissors blade 80, and the rocker 96 is associated with and located alongside the second scissors blade 82. The scissors pivot pin 78 is preferably of a length which when fully tightened leaves some axial clearance for the scissors blade base portion 86 and the respective rocker 94 or 96 so that they are generally free to move relative to each other, the pin 78, and the respective handle 34 or 36, as will be explained presently.

Each of the rockers 94 and 96 includes a projecting pin 100, which may be fastened thereto as a separate piece but preferably is formed by swaging the rocker. The pin 100 projects toward and into a slot 102 in the base portion 86 of the adjacent scissors blade 80 or 82, which receives the pin 100 of the associated rocker 94 or 96 and permits the rocker to rotate through only a limited angle with respect to the associated scissors blade 80 or 82, about the rocker pivot axis defined by respective scissors pivot pin 78. While the slot 102 is shown as a kidney-shaped slot extending entirely through the base portion 86 of each scissors blade 80 or 82, it is conceivable that the slot 102 may be of another shape or may not extend the entire distance through the respective base portion 86, so long as it receives the pin 100 and thus limits movement of the respective rocker when the rocker and base portion are located closely alongside each other.

Included within each of the handles 34 and 36 are a pair of springs, a scissors blade spring 104 and a rocker spring 106. As may be seen in FIGS. 5 and 7, these springs are generally similar in shape and are located side-by-side within each cavity 44 or 52. An anchoring end 108 of the scissors blade spring 104 and an anchoring end 110 of the rocker spring 106 include apertures which fit snugly on the respective tool pivot shaft 74. A hump 111 located in a middle portion of each rocker spring 106 protrudes into the cavity 44 or 52. A similar hump 111 is preferably present in the corresponding location on each scissors blade spring 104, but could optionally be omitted.

The springs 104 and 106 extend along the bottom 66 over a portion of the length of each handle 34, 36 to the bottom 112 of a slot defined in the end of bottom 66 nearer to the scissors pivot pin 78 of each handle. The respective tips 114, 116, of the scissors blade spring 104 and rocker spring 106 extend along the slot in the bottom 66 and are thus free to move toward and away from the respective scissors pivot pins 78, in contact with and following the shapes of the respective base portions 86 and rockers 94, 96, but the sides of the slot 112 keep the springs 104 and 106 from moving laterally and thus keep them aligned with the respective scissors blade 80 or 82 and rocker 94 or 96.

The tips 114 and 116 of the blade spring and rocker spring, respectively, are each tapered in width to be about 0.025 inch narrower than the anchoring ends 108 and 110, to provide lateral clearance between the adjacent spring tips 114 and 116, as shown in FIG. 5. This ensures that the springs can flex and the spring tips 114 and 116 can move independently of each other without the need for a spacer plate between the springs 104 and 106. The spring tips 114 and 116 are each also about 0.02 inch narrower than the thickness of each of the rockers 94, 96 and the base portions 86 of the scissors blades 80, 82 on which they act, to ensure that the spring tips 114 and 116 engage only the intended rocker 94 or 96 or the intended base portion 86. The anchoring ends 108 and 110, on the other hand, are together about 0.010 inch thicker than the combined thicknesses of the scissors blades 80, 82 and the rockers 94 and 96 so that the blades and rockers can be moved easily into the cavities 44 and 52 of the handles 34, 36.

With the folding tool 30 in the folded configuration shown in FIGS. 2–7, a generally flat surface 118 of each base portion 86 rests against each scissors blade spring tip 114, and a generally flat surface 120 on each rocker 94 or 96 rests against the rocker spring tip 116, with the respective tips 114 and 116 pressing against the flat surfaces 118 and 120.

Figure 7:
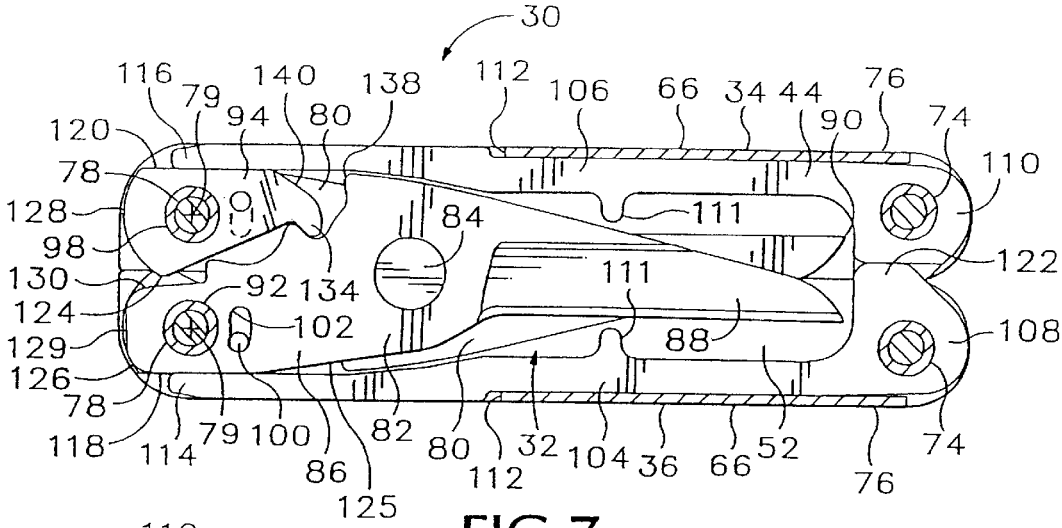
FIG. 7 is a sectional view of the multi-purpose tool shown in FIG. 1, taken along line 7—7 of FIG. 4.

The springs 104 thus urge the scissors blades 80, 82 to rotate about the respective scissors pivot pins 78 toward the stowed position shown best in FIG. 7, with the base portion 86 of each of the scissors blades 80, 82 nested snugly between the respective scissors blade spring 104 and the oppositely located rocker spring 106. As a result, the scissors blades are rotated with respect to each other about the scissors pivot joint 84 so that the blade tips 90 are located about 10° past each other, in a crossing configuration, when the scissors blades 80, 82 are in their respective stowed positions within the cavities 44, 52 defined by the handles 34, 36.

At the same time, the rocker springs 106 press against the flat surfaces 120 of the rockers 94, 96 urging them to rotate in the same direction as the respective base portion 86 with which each rocker is linked by the respective combination of a pin 100 and slot 102. The pin 100 is located so as to be in contact with the interior surface defining the slot 102 so that the force of the rocker spring 106 is carried through the pin 100 and slot 102 and helps to urge the scissors blades to rotate into the respective cavity 44 or 52 defined within the handle 34 or 36 with which the respective scissors blade 80 or 82 is interconnected. Because the scissors blades 80, 82 are interconnected through the scissors pivot joint 84, all four springs, both of the scissors blades springs 104 and both of the rocker springs 106, urge the scissors blades 80, 82 into the crossing configuration shown in FIG. 7 and urge the handles 34, 36 together to retain the tool 30 in its folded configuration.

Figure 3:
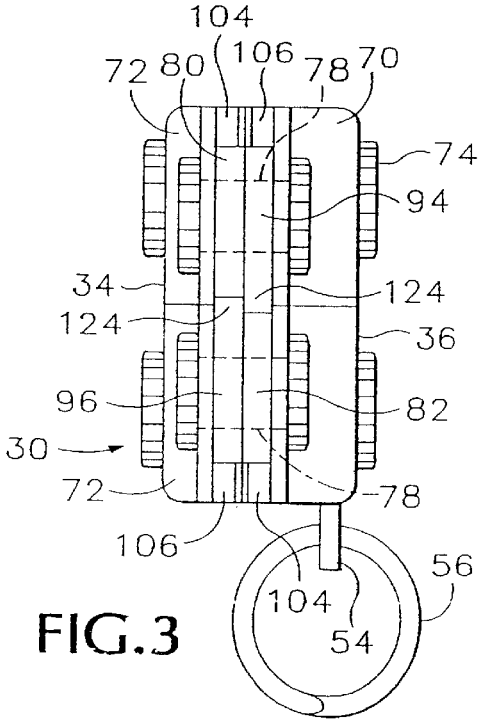
FIG. 3 is a scissors end view of the tool shown in FIG. 1, in the folded configuration shown in FIG. 2.
Figure 4:
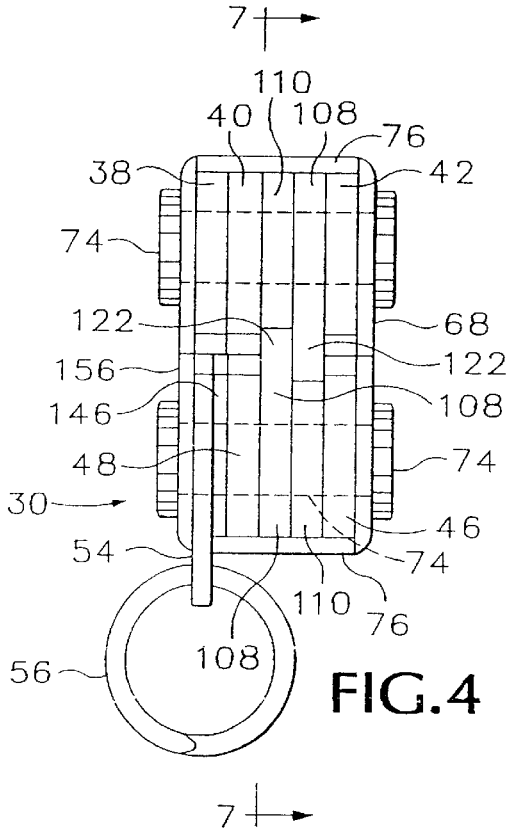
FIG. 4 is a tool bit end view of the tool shown in FIG. 1, in the folded configuration shown in FIG. 2.

When the tool 30 is in the folded configuration the ends of the handles 34 and 36 are held aligned with each other laterally by protruding ears 122 located on the anchoring ends 108 of the scissors blade springs 104, and by cam lobes 124 included in each of the rockers 94, 96. The ears 122 overlap and are located alongside each other and between each other and the base of an adjacent folded tool blade, as shown in FIG. 4, keeping the tool bit ends of the handle aligned with each other. The cam lobes 124 similarly extend alongside each other and between each other and one of the side walls 68 in the narrow scissors end portion 64 of the opposite handle 34 or 36, as shown in FIG. 3, keeping the scissors ends of the handles 34, 36 aligned. The ears 122 may, as shown in FIG. 4, slightly narrower than the rest of the anchoring end 108 or 110 to avoid interference as they pass by each other as the tool 30 is being folded. It will be understood that the ears 122 might be provided on the rocker springs 106 instead of the scissors blade springs 104 with the same results.

Each scissors blade 80 and 82 has an outer margin 125 which rests closely along an inner surface of the tip 116 and a very small distance away from the hump 111 of the opposite rocker spring 106 inside the opposite cavity 44 or 52. The tool 30 in its folded configuration thus is as compact as practical, yet each scissors blade incorporates all the material for which there is room within the cavity to ensure adequate strength.

Figure 8:
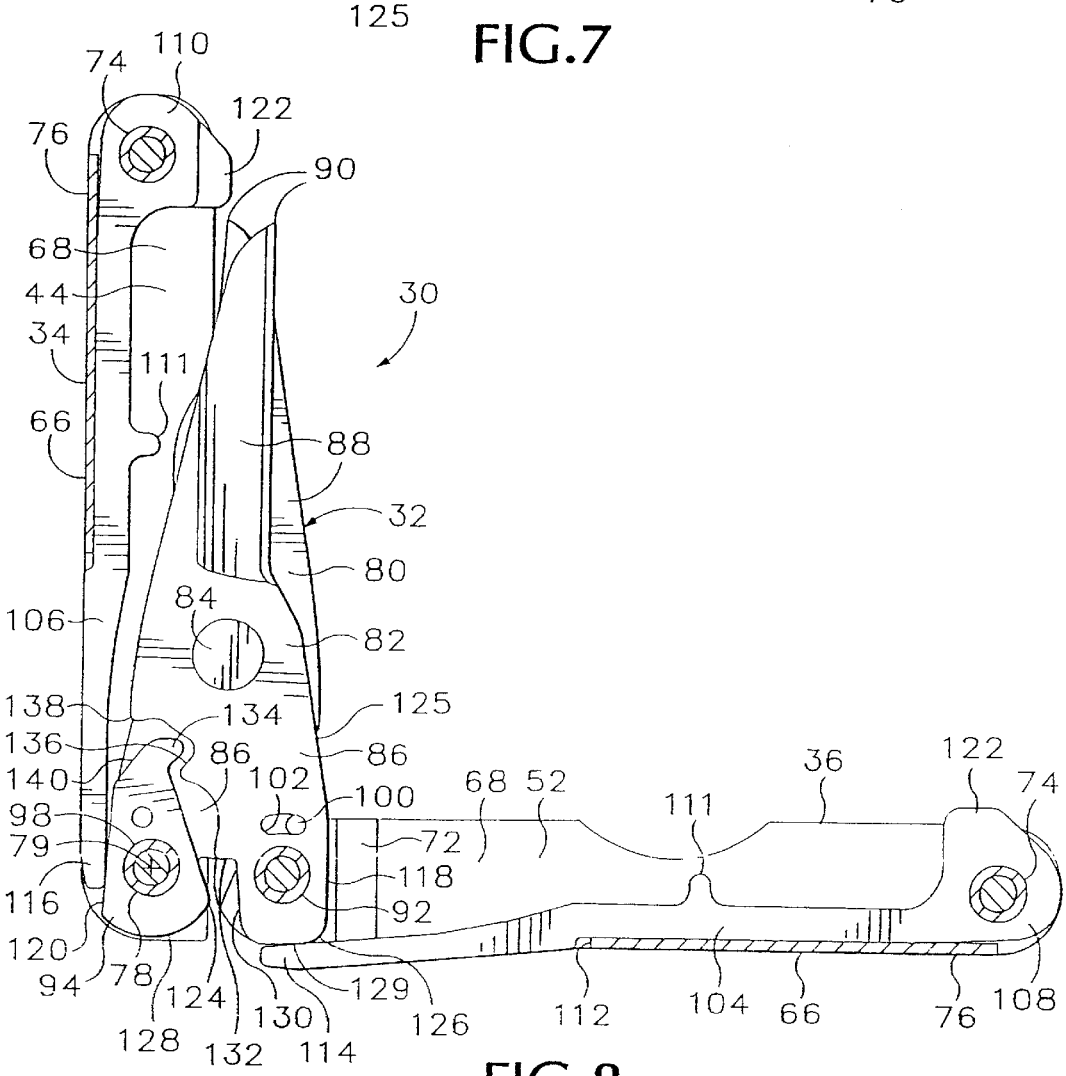
FIG. 8 is a sectional view similar to that of FIG. 7, showing the multi-purpose tool with one handle in a partially extended position.

For use, the scissors 32 are deployed from the folded configuration of the folding tool 30 by separating the handles 34, 36, rotating each of the scissors blades 80, 82 about one of the scissors pivot pins 78 with respect to the handle 34 or 36 with which it is interconnected. As the scissors blades 80, 82 are rotated with respect to the handles 34, 36, for example, by rotation of the second blade 82 with respect to the handle 36 to the position shown in FIG. 8, both the scissors blade spring 104 and rocker spring 106 of the respective handle are forced to flex away from the scissors pivot pin 78 by respective cam surfaces 126 of the base portions 86 of the scissors blades, and similar cam surfaces 128 of the rockers 94, 96. The cams at first strongly resist movement of the scissors blades 80 and 82 away from their stowed positions within the cavities 44 and 52, and because of the linking provided by the pin 100 within the slot 102, both the scissors blade base portions 86 and the rockers 94 and 96 resist such relative movement of the scissors blades 8C and 82 away from their stowed positions in the cavities 44 and 52. Once the spring tips 114 and 116 are resting against the cam surfaces 126, 128, however, only friction resists further movement of the handles through a small angle, after which the spring tips 114 of the scissors blades springs 104 encounter the flat detent surface 129 on the base portion 86 of each of the scissors blades 80 and 82. Each flat detent surface 129 is oriented approximately perpendicular to the length of the respective scissors blade 80 or 82, and acts together with the respective scissors blade spring tip 114 as a detent to hold the respective handle 34 or 36 stable with respect to the scissors blade 80 or 82, in a position similar to that of the handle 36 as shown in FIG. 8. This position improves the ease and safety of gaining access to the tool bits stowed in the particular handle, such as the screwdriver and cap lifter 46, the flat Phillips screwdriver 48, and the tweezers 50, in the handle 36. When both handles 34 and 36 are similarly positioned the respective detents hold the two handles in line with each other so that a scale 131 inscribed on the handles can be used for measurements up to the combined lengths of the two handles 34 and 36.

Figure 9:
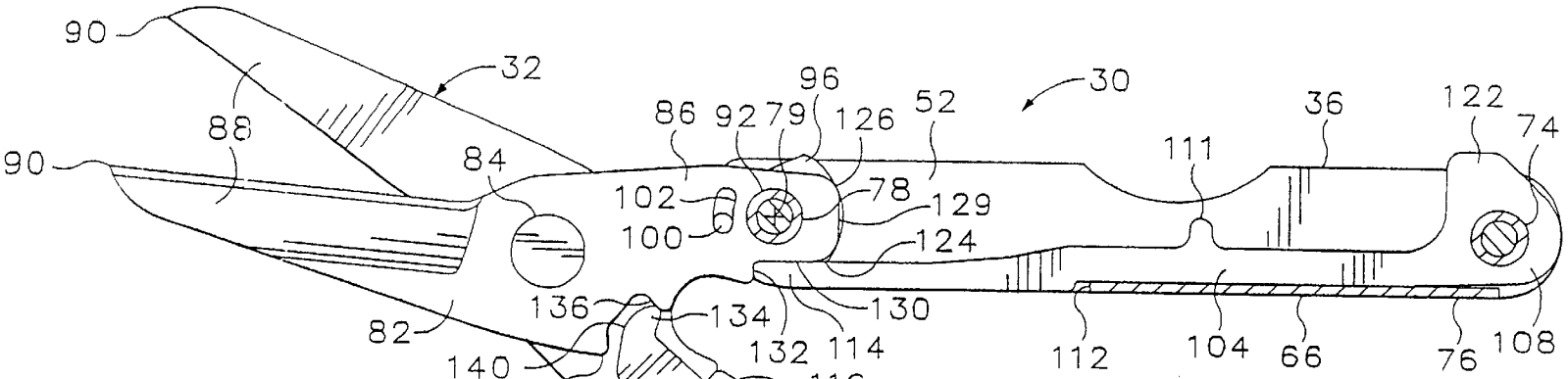
FIG. 9 is a sectional view of the same portion of the tool as shown in FIG. 7, showing both handles extended with the scissors blades of the multi-purpose tool in their deployed, open positions, ready for use.

Moving each handle 34 or 36 further in the same direction with respect to the attached scissors blade 80 or 82 brings the respective scissors blade spring tip 114 onto the flat surface 130 on each base portion 86, and the force of each scissors blade spring 104 then urges the respective scissors blade to rotate toward the deployed position shown in FIGS. 1 and 9.

When a scissors blade 80 or 82 is in the deployed position the respective spring tip 114 of the scissors blade spring 104 rests against a handle extension stop 132 which then prevents the handle from moving further with respect to the scissors blade base portion 86. As a result, when both of the blades 80, 82 are deployed, with the handles 34, 36 fully extended as shown in FIG. 9, the scissors blade springs 104 and rocker springs 106 face toward each other. Movement of the handles 34, 36 toward each other then results in movement of the cutting portions 88 of the scissors blades toward each other in a scissors blade closing direction.

Each of the rockers 94, 96 includes a finger-like outer end 134 which rests against a cam surface 136 of the base portion 86 of the opposite scissors blade. Thus the outer end 134 of the rocker 94 rests against the cam surface 136 of the base portion 86 of the scissors blade 82 as shown in FIGS. 1 and 9. Since the cam lobe 124 of the rocker 94 rests against the rocker spring 106 associated with the handle 34, movement of the handles 34, 36 toward one another is resisted by the force of the spring 106 as the cam face 136 moves into contact with the outer end 134 of the rocker 94 and moves it in a counterclockwise direction about the scissors pivot pin 78 of the handle 34. As the handles 34, 36 are moved toward each other to move the cutting portions 88 toward each other in a cutting motion of the scissors blades 80, 82 about the scissors pivot joint 84, the rocker springs 106 oppose further movement in such a scissors-closing direction. However, because of the size of the slot 102 or equivalent opening defined in the base portion 86 of the blade 80, the rocker 94 is free to move counter-clockwise about the scissors pivot pin 78 with respect to the scissors blade 80, except as such movement is opposed by the rocker spring 106 of the handle 34.

As the outer end 134 moves along the cam surface 136 toward the scissors pivot joint 84, the lever arm lengths about the scissors pivot pin 78 and the scissors pivot joint 84 change. The force required to continue to move the handles 34, 36 toward each other thus increases less than the force exerted by the spring 106 increases, and the force on the handles 34 required for closing the cutting portions 88 of the scissors blades does not increase unpleasantly during a complete cutting stroke of the scissors 2.

Figures 10, 12:
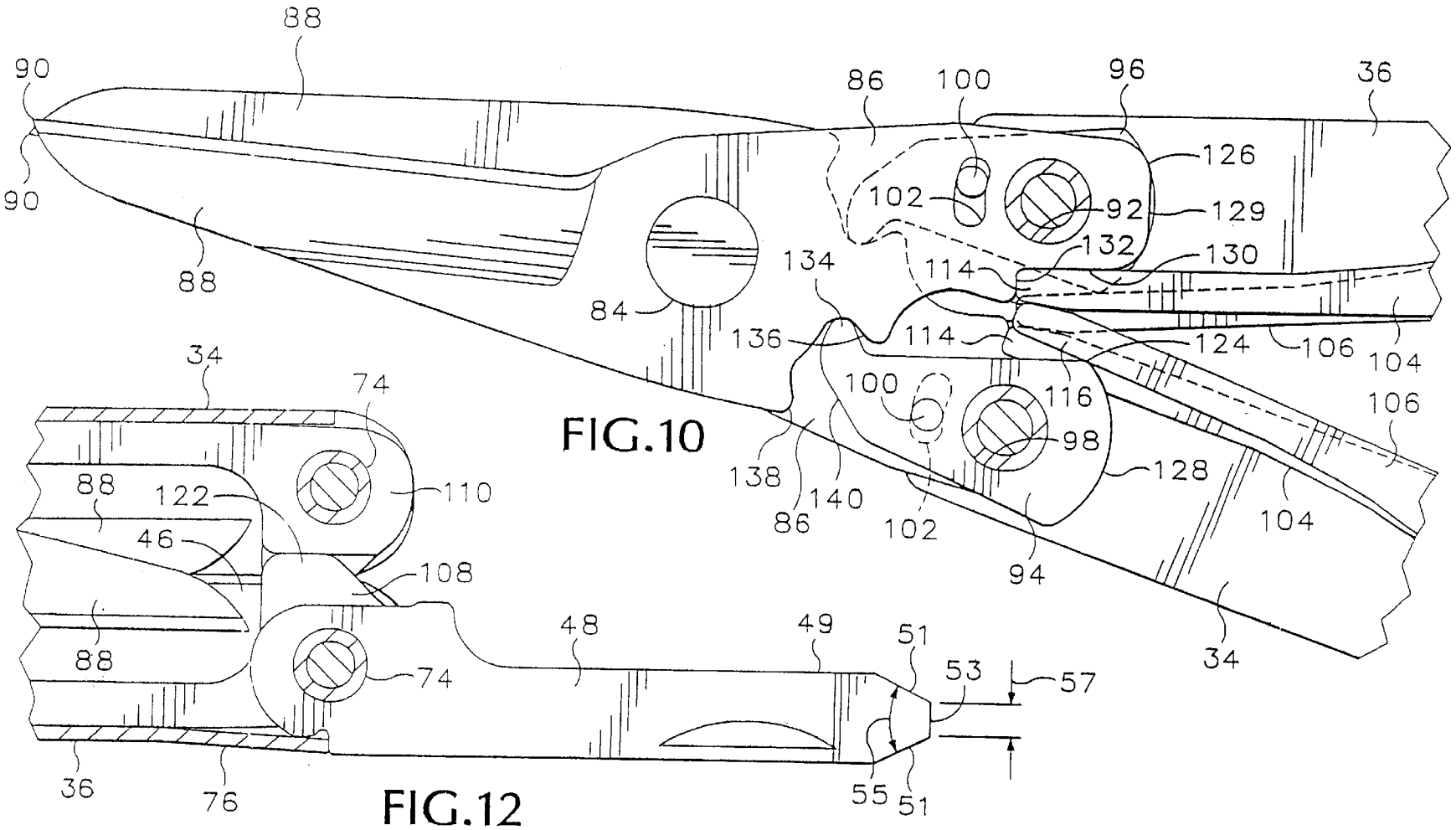
FIG. 10 is a sectional view, similar to that of FIG. 9, of a detail of the scissors and a portion of each of the handles of the tool with the scissors blades moved toward each other to their fully closed position.
FIG. 12 is a sectional view of a portion of the tool bit end of the multi-purpose tool, taken in the direction of line 7—7 in FIG. 4, showing the flat Phillips screwdriver blade in its deployed position.
Figure 14:
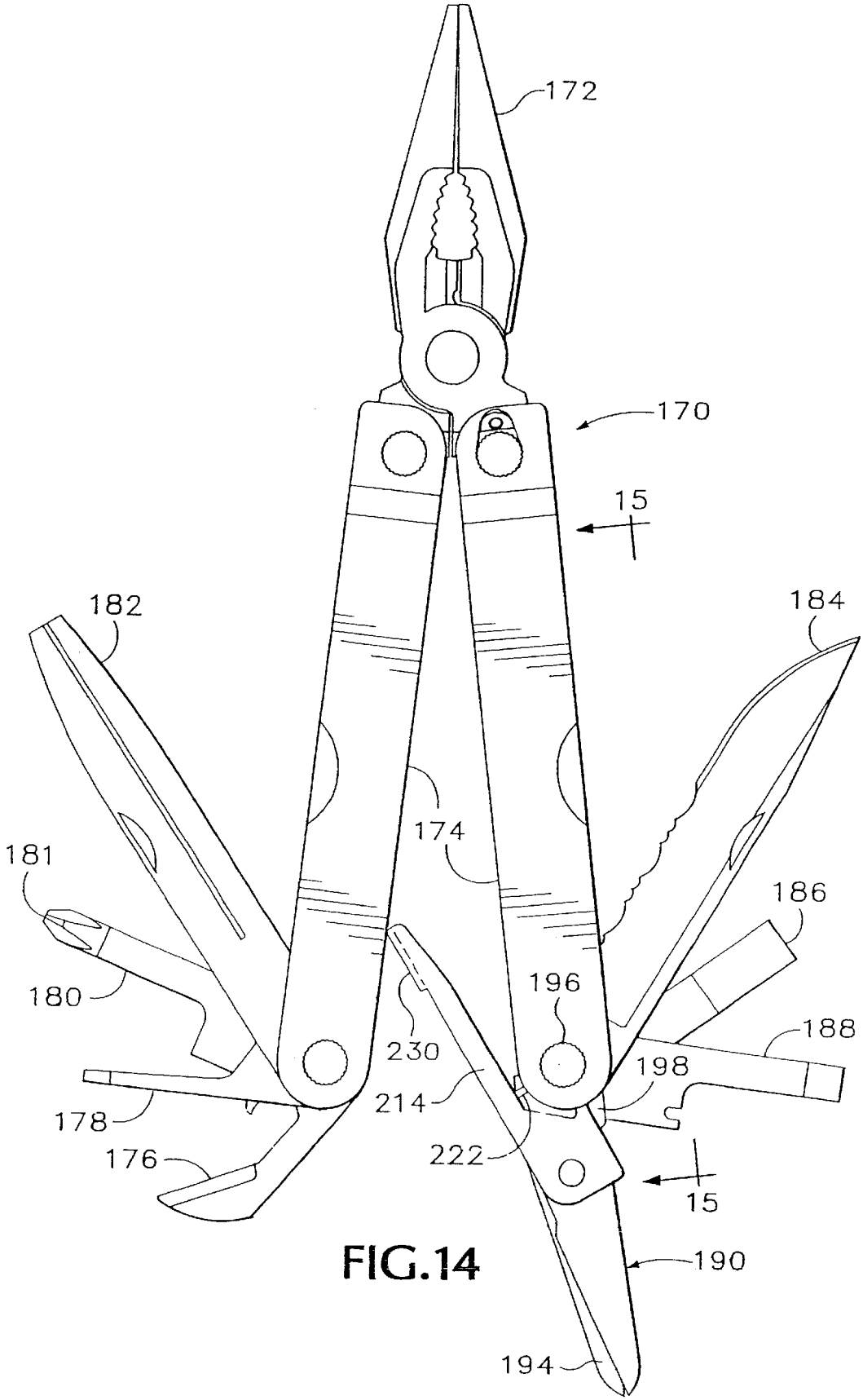
FIG. 14 is an elevational view of a multi-purpose folding tool which is another embodiment of the present invention.

Referring now to FIG. 10, when the cutting portions 88 of the scissors blades have completed a cutting stroke the blade tips 90 are barely past one another. Rotation of the rockers 94, 96 has then flexed each rocker spring 106 so that its tip 116 is displaced toward the facing spring tip 114 of the scissors spring 104 of the opposite handle. Each spring tip 116 is thereby moved into contact with the spring tip 114 in the opposite one of the handles 34 and 36 preventing further movement of the handles 34, 36 toward each other, completing a cutting or blade-closing stroke of the scissors 32.

When pressure on the handles 34, 36 is released, the potential energy stored in the rocker springs 106 moves the rockers 94, 96. The outer ends 134 act upon the cam surfaces 136 of the opposite base portions 86, so that the rocker springs 106 open the cutting portions 88 of the scissors blades in preparation for a subsequent cutting stroke.

Figure 11:
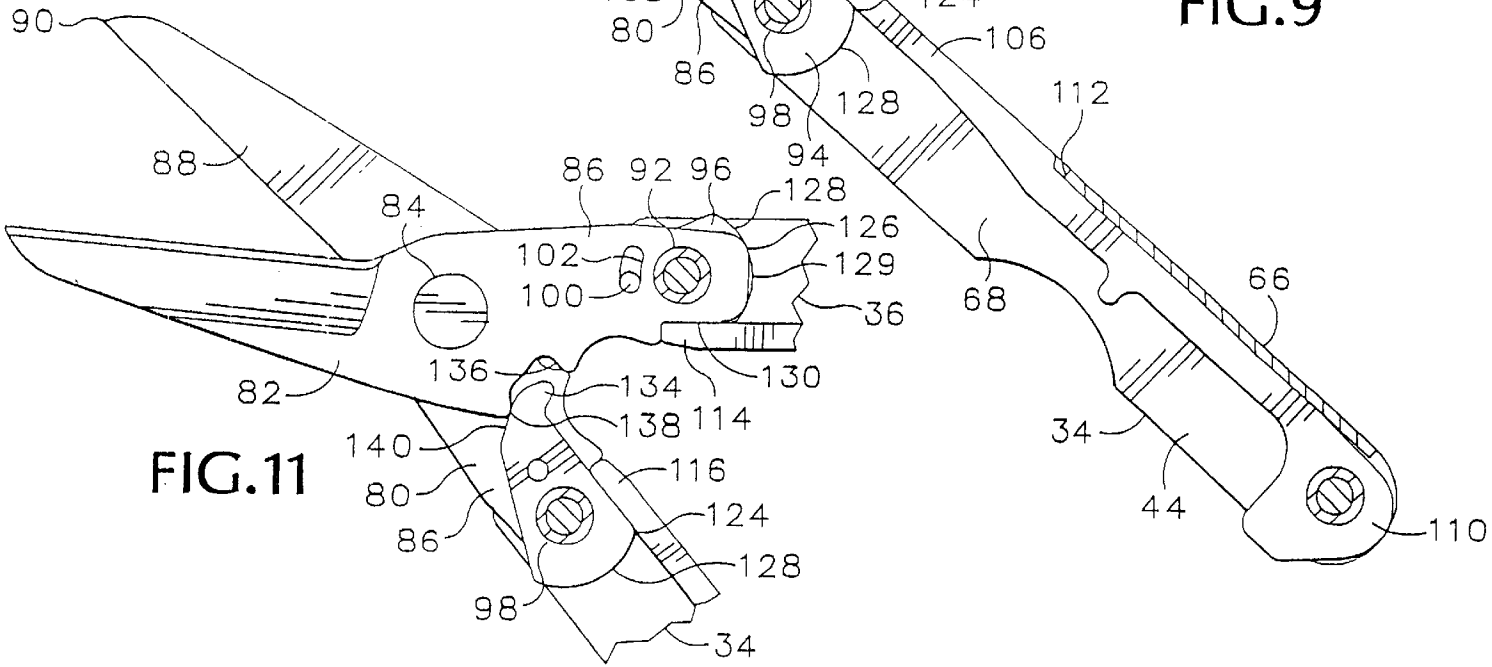
FIG. 11 is a sectional detail view of the same portion of the tool shown in FIG. 9, showing the scissors blades opened further to their maximum separation.

The scissors blades are prevented from opening beyond a desired position where the edges of the cutting portions 88 are still registered with one another ready to cut material, by a scissors opening stop 138 included in the base portion 86 of each of the scissors blades. The scissors opening stop 138 encounters an outer face 140 of the rocker, as shown in FIG. 11, rotating the rocker 94 clockwise and the rocker 96 counterclockwise, as shown, until the pin 100 engages the interior of the slot 102 into which it extends and thereby is prevented from rotating further with respect to the base portion 86 of the scissors blade interconnected with the one of the handles on which the particular rocker is located.

When it is desired to return the tool 30 to its folded configuration with the scissors blades 80, 82 in their stowed position within the cavities 44, 52, it is necessary simply to move the handles 34, 36 away from each other beyond the position where the scissors blades are prevented from opening further. The scissors blades springs 104 and rocker springs 106 are thereby flexed as their tips 114, 116 again encounter the cam faces and flats 126, 128. When the spring tips 114, 116 begin to ride off the cam surfaces 126, 128 they again act against the flat surfaces 118 of the base portions 86 and the fiat surfaces 120 of the rockers 94, 96 to urge the handles 34, 36 to spring toward one another into the folded configuration as described previously.

As the handles 34, 36 are moved toward their respective folded positions, hump 111 of the respective rocker spring 106 approaches the outer margin 125 of each of the blades 80, 82. If the tool bit ends of the handles move closer toward each other than the separation between the scissors ends of the two handles at that time the hump 111 causes the scissors blades 80 and 82 to rotate about the scissors pivot joint 84 toward the crossing configuration, thus bringing the scissors pivot pins 78 and the scissors ends of the handles closer together. As a result, the tool moves smoothly into the folded configuration regardless of where pressure is applied along the length of each handle 34 or 36.

With the appropriate one of the handles 34 or 36 moved to a position such as that of the handle 36 as shown in FIG. 8, a desired one of the additional tool blades can be rotated into an extended position such as the position of the flat Phillips screwdriver blade 48 as shown in FIG. 12. The handles 34, 36 can then be returned to the closed configuration with respect to each other while the extended tool blade is held in place by the action of the leaf spring 76 against a base portion of the tool blade in the manner well-known in folding knives. With the handles 34, 36 held close together by the action of the scissors blade springs 104 and rocker springs 106, and with the ears 122 of the scissors blade springs and the cam lobes 124 of the rockers 94, 96 extending into spaces provided alongside each other in the opposite handles as explained previously, the handles 34, 36 are held in place with respect to each other, allowing screwdriver blades to be used without the handles 34, 36 being displaced laterally from each other by the twisting force used.

The above-described arrangement for holding a folding tool incorporating the scissors blades 80, 82 in a folded configuration and for urging the blades 80, 82 open when they are in their deployed position with respect to the handles may also be used for operation of tools such as pliers or special grasping tools, not shown, which include a pair of relatively movable interconnected members such as jaws or jawlike members which pivot with respect to each other about a jaw pivot joint corresponding to the scissors pivot joint 84. Such jaws or jawlike members include acting portions corresponding to the cutting portions 88 of the scissors blades 80, 82, and an arrangement of springs, which may be referred to in such devices as jaw springs, corresponding to the scissors blade springs 104 would act upon base portions of the jaws or jawlike members of such a tool. Similarly, such a tool would include rockers such as the rockers 94, 96 linked with the base portion of such jawlike members and interacting with such jawlike members to limit their movement appropriately and to assist in keeping the folding tool including such jaws or jawlike members securely in its folded configuration.

In order to make the folding tool 30 as compact as possible yet have a Phillips screw driving capability, the flat Phillips screwdriver blade 48 is generally planar, rather than having a cruciform driving end. The blade 48 tapers similar to the flutes of a Phillips screwdriver from a maximum thickness at 49, beyond the angled faces 51, to a minimum thickness of 0.022 inch at the transverse end face 53. The angled faces 51 form an included angle 55 of 53°, corresponding to the shape of a Phillips head screw socket, and the transverse end face 53 preferably has a width 57 of 0.074 inch, which is narrow enough to fit into the socket of most Phillips screws intended to accept a No. 1 Phillips screwdriver. However, because the flat Phillips screwdriver blade 48 lacks a pointed end, and is thus wider at its transverse end face 53 than a normal Phillips screwdriver, it fits drivingly in the socket of a Phillips screw intended to be driven by a No. 2 Phillips screwdriver. The flat Phillips screwdriver blade 48, then, although generally planar, can be used to function in place of either a No. 1 or a No. 2 Phillips screwdriver.

Figure 6:
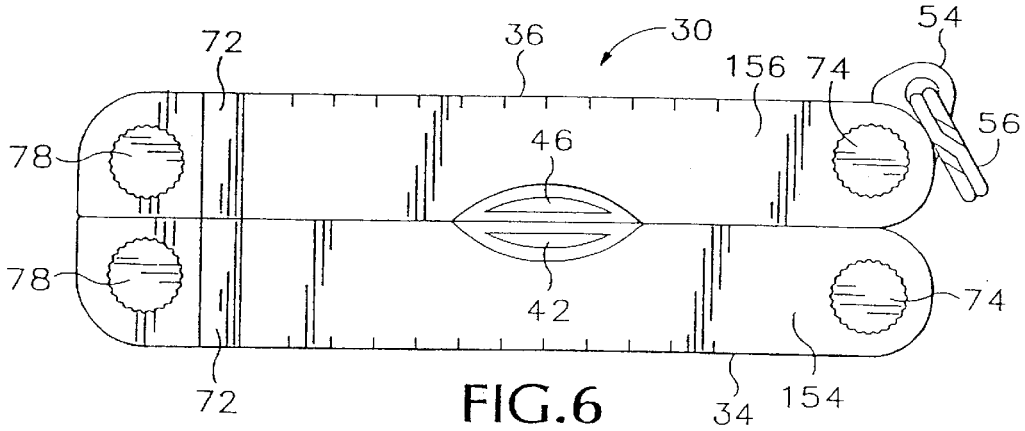
FIG. 6 is a right side view of the multi-purpose tool shown in FIG. 1, in the folded configuration shown in FIG. 2.
Figure 13:
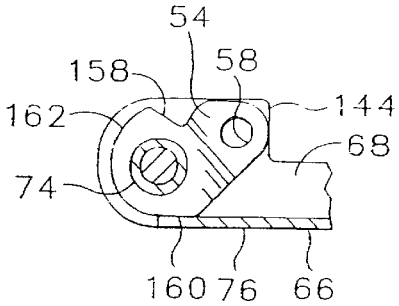
FIG. 13 is a sectional view of a portion of one of the handles of the tool, taken in the direction of line 7—7 of FIG. 4, showing the lanyard attachment eye in a pocket-carried configuration of the tool.

An opening 144 is defined in one of the side walls 68 of the handle 36, and the tweezers 50, which include a base portion 146 and a pair of legs 148, are stowed generally within the cavity 52, alongside the flat Phillips screwdriver 48. Each of the legs 148 has a length extending parallel with the handle 36 as shown in FIG. 6, a thickness 150, and a width 152, indicated in FIG. 5, so that as shown herein an outer side face 154 of each leg 148 is located generally flush with an outer face 156 of the side wall 68 defining the opening 144. The provision of the opening 144 permits the width 152 of each tweezers leg 148 to be greater than would otherwise be possible given the overall size of the handle 36, and it also permits each tweezers leg 148 to have an even greater width 152 where it is acceptable for the outer side faces 154 to protrude beyond the outer face 156.

The tweezers 50 may be made by cutting a flat sheet of metal to include the base 146 and legs 148, and then folding the legs 148 upward to bring the legs 148 perpendicular to the base 146 with the outer side faces 154 in a single plane. The legs 148 are thus thinner than they are wide and are oriented with their width generally perpendicular to the plane of the base portion 146.

The lanyard ear 54 is mounted rotatably on the same tool pivot shaft 74 on which the base portion 146 of the tweezers 50 is located. The lanyard attachment ear 54 is located between the base portion 146 of the tweezers 50 and the nearer side wall 68, acting there as a spacer to locate the base portion 146 of the tweezers axially along the tool pivot shaft 74 on which both are located for rotation. The lanyard attachment ear 54 is movable selectively in the direction of the arrow 60, between the position shown in FIG. 2 and that shown in FIG. 13, which requires prior removal of the split ring 56 from the hole 58. In either of the positions described, the leaf spring 76 in its normal relaxed position extends along one of the two flat surfaces 158 and 160. Movement of the lanyard attachment ear 54 between the two positions, however, results in a cam surface 162 between the two flat surfaces 158 and 160 being brought to bear against the leaf spring 76, which opposes such movement. Thus, the lanyard attachment ear 54 is held stably in the position shown in FIG. 13, resulting in the exterior surface configuration of the folding tool 30 being generally smooth and unlikely to cause excessive wear in a pocket of a person's clothing as a result of carrying the tool 30.

Turning now to FIGS. 14–23, a folding multi-purpose tool 170 includes a pair of pliers 172 equipped with channel-shaped handles 174 which can be rotated around the pliers jaws to house them within the cavities 192 defined by the handles 174. A plurality of other tools are mounted in the handles 174 at the ends spaced apart from the pliers jaws, where the additional tool blades, such as a can opener 176, a small screwdriver 178, a Phillips screwdriver 180, and a file 182 are selectively available or stored in one of the handles 174, while a knife blade 184, a large screwdriver 186, a medium screwdriver 188 and a pair of folding scissors 190 are associated with the other one of the handles 174. With all of the tool blades stored within the respective handles 174 room remains for the pliers jaws 172 also to be enclosed within the cavities 192. The entire tool 170 in its folded configuration presents a neat appearance and is free from significant protrusions, so that it can be carried as a pocket tool.

The Phillips screwdriver 180 has a flat tip 181 so that the shape is equivalent to that of the standard No. 1 Phillips screwdriver except for effectively being 0.030 inch shorter as a result of omission of the pointed end of the standard Phillips screwdriver shape. The modified Phillips screwdriver 180 of the invention is therefore able to fit deep enough into a No. 2 Phillips screw to engage it effectively, as well as being effective for driving all but the very smallest No. 1 Phillips screws.

Figure 15:
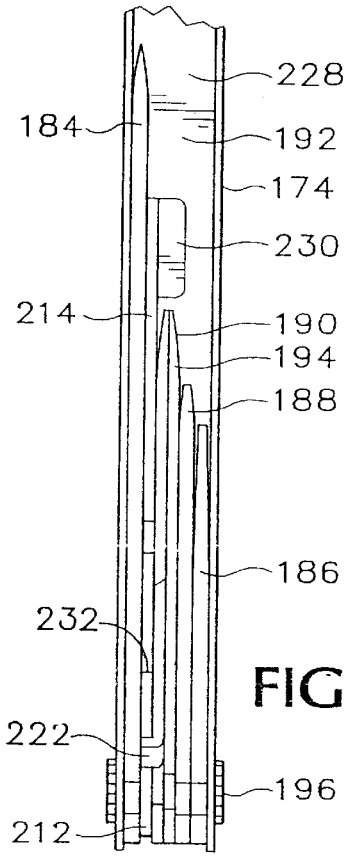
FIG. 15 is a view of a part of the tool shown in FIG. 14, taken in the direction of line 15—15, with the scissors and other adjacent tools stowed in one handle.

Referring next to FIG. 15, it may be seen that the folding scissors 190 are stowed between the knife blade 184 and the medium screwdriver blade 188 in the cavity 192 defined by the handle 174. The scissors 190 are movable from this stowed location within the cavity 192 to the deployed position shown in FIG. 16 by rotating a first blade 194 about a tool pivot shaft 196 which may be similar to the tool pivot shaft 74 described in connection with the folding tool 30. When ready for use the scissors 190 are in the position shown in FIG. 16, and the handles 174 are located alongside each other.

Figure 17:
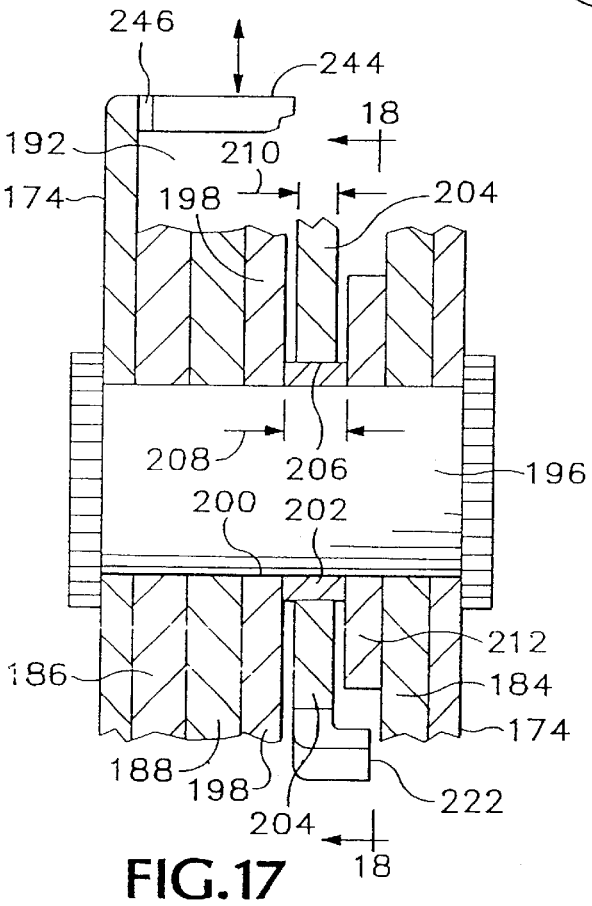
FIG. 17 is a sectional view taken along line 17—17 of FIG. 16.

As shown in FIG. 17, base portion 198 of the first scissors blade 194 defines a bore 200 fitted about the tool pivot shaft 196 for rotation, and is located between a further spacer 202 and the knife blade 184. A rocker 204 defines a bore 206 which fits around the spacer 202. The spacer 202 is in the form of a small ring which fits about the tool pivot shaft 196 and has en axial thickness 208 slightly greater than the thickness 210 of the rocker 204. The spacer 202 fits closely on the tool pivot shaft 196 between the base portion 198 of the first blade 194 and a second spacer 212 resembling a small flat washer. The spacer 212, which may be made integrally with spacer 202, also fits closely on the tool pivot shaft 196, but extends radially beyond the periphery of the spacer 202, between the rocker 204 and the knife blade 184, thus keeping the rocker 204 located closely adjacent to the base portion 198 of the first blade 194. The spacer 202 provides a small axial clearance, about 0.006 inch, for example, for the rocker 204, between the spacer 212 and the base portion 198, so that the rocker 204 remains free to rotate about the spacer 202 independent from rotation of the first blade 194 about the tool pivot shaft 196.

An operating lever 214 and a second blade 216 are attached to the first blade 194 for rotation about a scissors pivot axis 217 defined by a rivet 218 whose opposite ends are countersunk in the first blade 194 and the operating lever 214. Preferably, a preformed head 223 of the rivet 218 is countersunk in the first blade 194 to ensure clearance between the first blade 194 and the adjacent medium screwdriver 188, while slightly more clearance is available for the peened outer end 215 of the rivet 218 because of the spacer 212.

Figure 24:
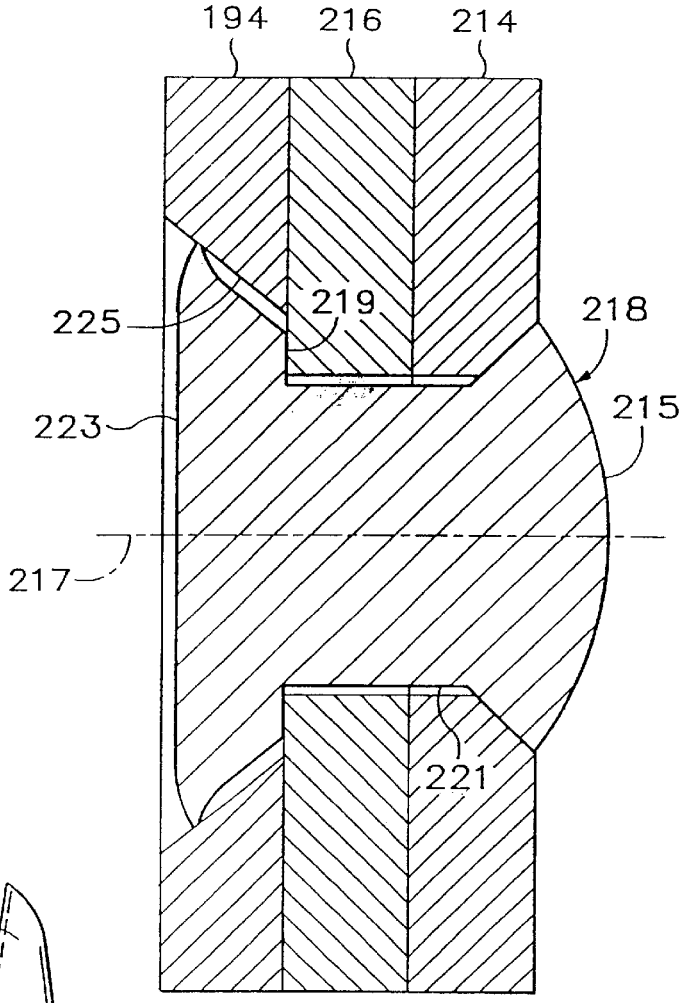
FIG. 24 is a sectional view taken along line 24—24 of FIG. 16 at an enlarged scale.

Referring to FIG. 24, it may be seen that the rivet 218 includes a shoulder 219 larger in diameter than the body 221 of the rivet, so that the extent of peening the outer end 215 regulates the tension with which the operating lever 214 is held closely against the second blade 216. Preferably, the operating lever 214 is held snugly alongside the second blade 216 so that the operating lever is not able to swing freely with respect to the second blade 216 yet can be moved by application of moderate force. The preformed head 223 of the rivet 218 and the chamfered bore 225 in the first scissors blade 194 cooperate to keep the second blade 216 closely alongside the first scissors blade 194 yet permit the blades 194 and 216 to pivot freely with respect to each other. Excess clearance can be taken up by peening the margin of the preformed head 223 to ensure that the blades cooperate closely to cut in scissors fashion.

Figure 16:
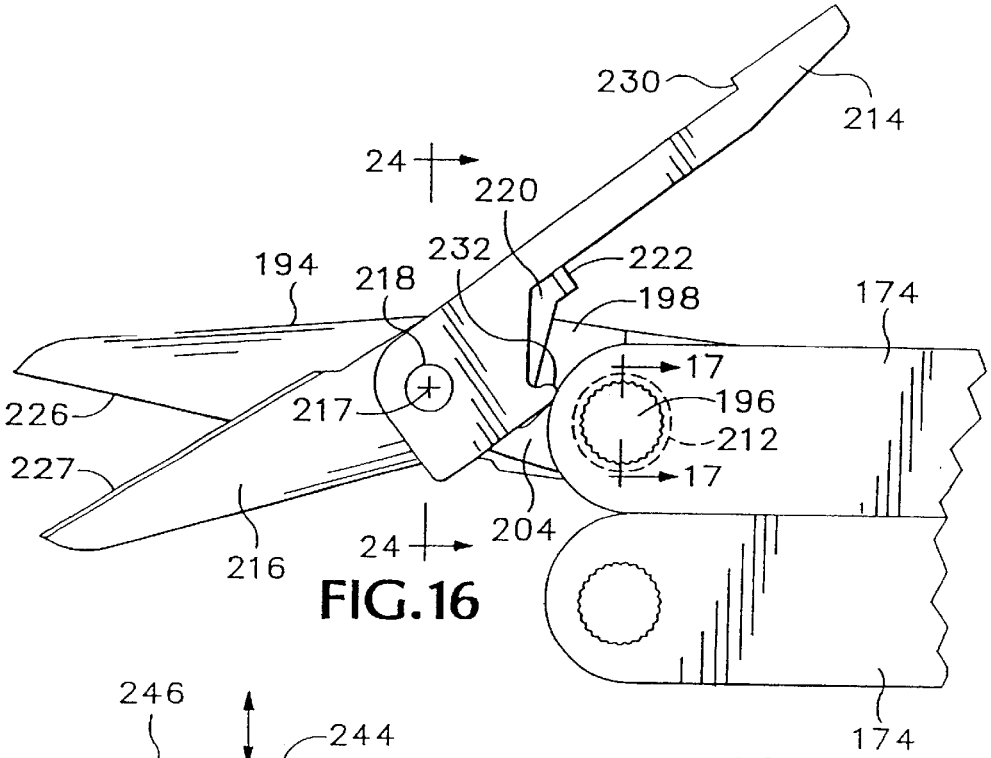
FIG. 16 is an elevational view of the tool shown in FIG. 14, with the handles folded together around the pliers jaws and with the folding scissors deployed, but with the remaining tool bits in their folded positions.

The second blade 216 includes a base portion 220 from which an integral ear 222 is bent away from the first blade 194 into the plane of rotation of the operating lever 214 about the axis 217, so that movement of the operating lever 214 in a clockwise direction as shown in FIG. 16 brings the operating lever 214 to bear against the ear 222. Further rotation of the operating lever 214 in a clockwise direction causes the second blade 216 also to rotate clockwise about the scissors pivot axis 217 with respect to the first blade 194. This causes respective scissors blade cutting portions 224 and 226 to move toward each other in a blade-closing scissors action when the-scissors are deployed as shown in FIG. 16.

Figure 18:
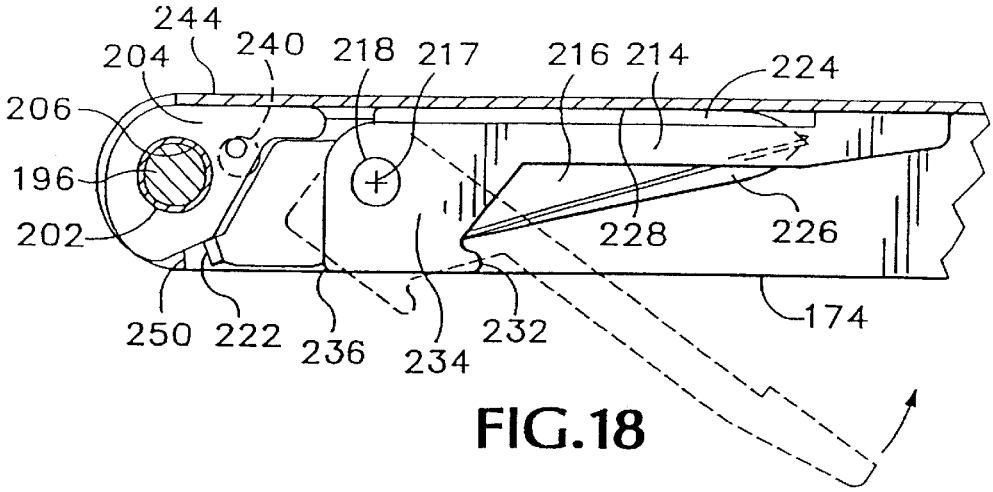
FIG. 18 is a sectional view of the folding scissors and a portion of the handle with which the folding scissors is associated, taken along line 18—18 of FIG. 17, but omitting the other tools folded within the handle, for the sake of clarity in illustration of the scissors of the present invention.

When the folding scissors 190 are stowed entirely within the cavity 192, as shown in FIGS. 15 and 18, the cutting portions 224 and 226 respectively of the first and second scissors blades 194 and 216 are in a fully closed position with respect to each other and lie closely against the bottom 228 of the cavity 192. A handle tab 230 on the operating lever 214 extends transversely in the direction of the blades 194 and 216. The tab 230 provides a surface against which to push comfortably to operate the scissors and is spaced far enough away from the scissors pivot axis 217 that it passes clear of the tips of the cutting portions 224, 226 and also rests against the bottom 228.

A small ear 232 is defined on the base portion 234 of the operating lever 214, and can be engaged by a fingernail to start to move the operating lever 214 from its stowed position. A rounded portion of the margin of the base portion 234 is spaced away from the bottom 228 of the handle 174, allowing the operating lever 214 to be pivoted freely about the scissors pivot axis 217, as indicated by the broken line outline of the operating lever 214 in FIG. 18, until a corner 236 of the base portion 234 encounters the bottom 228. Thereafter, further rotation of the operating lever 214 in a clockwise direction, with the corner 236 acting as a cam, forces the first blade 194 to rotate away from the bottom 228 about the tool pivot shaft 196, carrying with it the second blade 216.

The rocker 204 includes a pin 238 similar to the pins 100 in the rockers 94 and 96 described in connection with the folding scissors 32. The base portion 198 of the first blade 194 also defines a hole 240 functionally similar to the slot 102 defined in the base portions 86 of the scissors blades 80, 82 of the folding scissors 32. The pin 238 protrudes laterally from the rocker 204 into the hole 240, so that movement of the first blade 194 more than a small distance moves the rocker 204, linked to it by the combination of the pin 238 and the hole 240, as shown in FIGS. 19 and 20.

Figure 19:
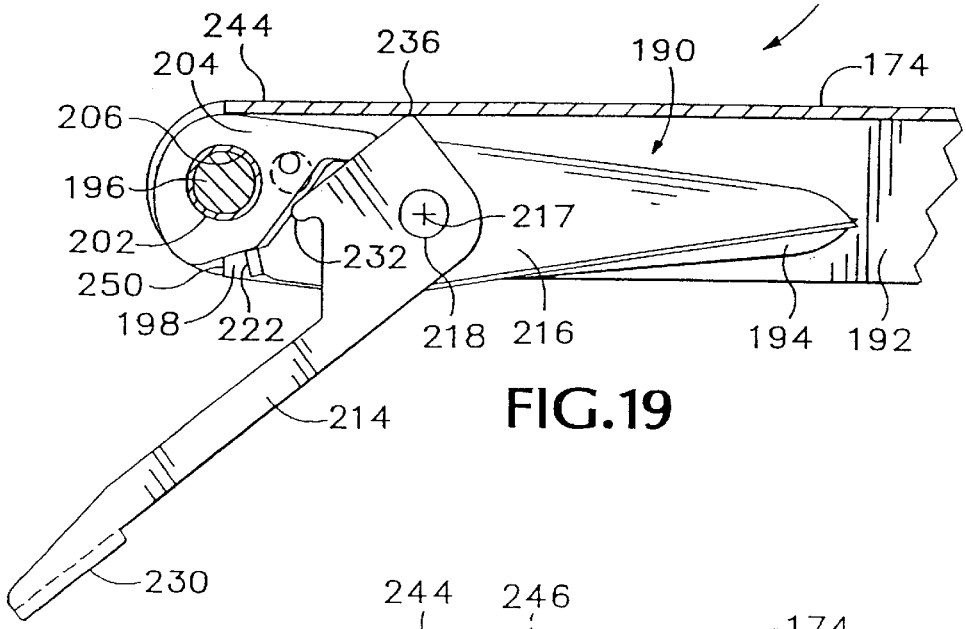
FIG. 19 is a sectional view similar to that of FIG. 18, showing the operating lever of the folding scissors at an intermediate position during unfolding of the scissors blades from the fully stowed position.
Figure 20:
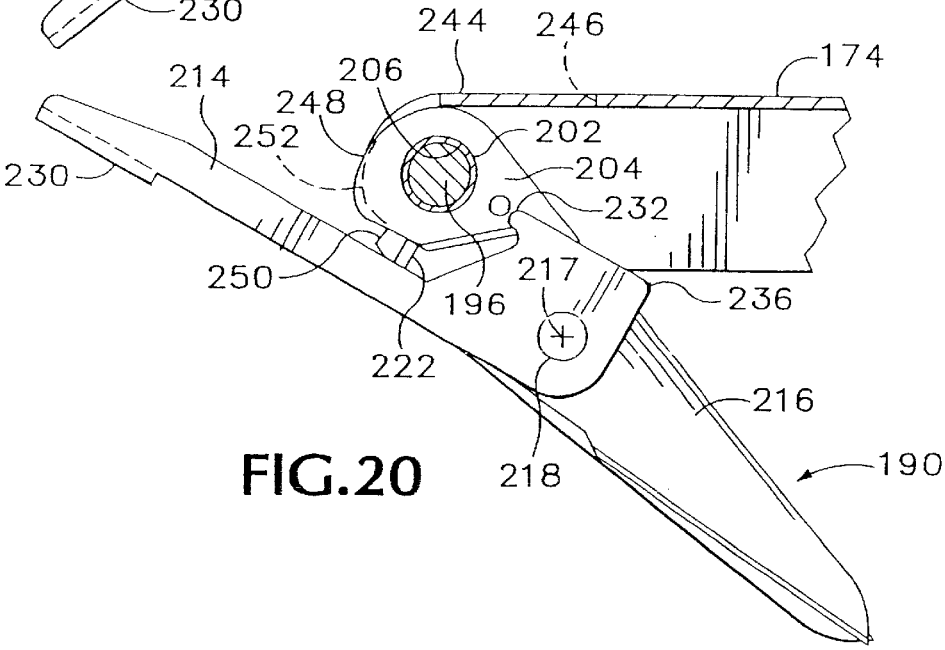
FIG. 20 is a view similar to that of FIG. 18, with the operating lever rotated further and showing the manner in which the operating lever moves the scissors further from the stowed position toward their deployed position.

As the operating lever is rotated in a clockwise direction beyond the position shown in FIG. 19 it encounters the ear 222 and pushes the base portion 242 of the second blade 216 toward and into contact with the rocker 204. The rocker 204 prevents further movement of the second blade 216 in a blade closing direction with respect to the first blade 194, so that subsequent movement of the operating lever 214 clockwise as shown in FIG. 20 moves the entire folding scissors 190 clockwise by moving the first scissors blade 194 about the tool pivot shaft 196. The operating lever 214 thus provides advantageous leverage for moving the folding scissors 190 to an operating position without the need to push against the sharp tips of the blades 194 and 216.

The shape of the base portion 198 of the first blade 194 is such that further rotation of the first blade 194 in a clockwise direction brings the base portion 198 into contact with a leaf spring 244 formed integrally with the handle 174 and defined by a pair of parallel slots 246, one on each side of the bottom 228 (see FIG. 17). With further rotation of the first blade 194, a cam surface 248 on the rocker 204, carried along with the first blade 194 by the linking contact of the pin 238 with the interior of the hole 240, deflects the spring 244 further, until a handle extension stop 250, defined on the base portion 198 of the first blade 194, abuts against the spring 244, preventing further movement of the first blade 194 about the tool pivot shaft 196.

Figure 21:
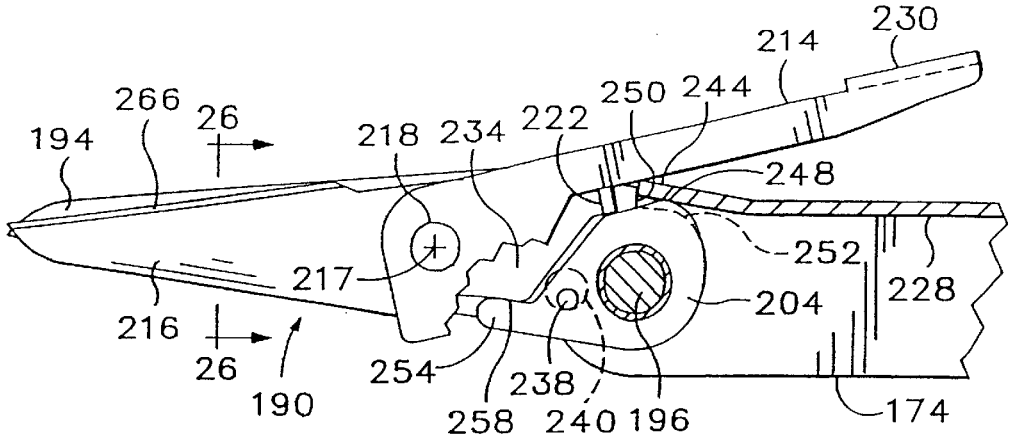
FIG. 21 is another view similar to FIG. 18, showing the folding scissors deployed, with the operating lever partially cut away and the scissors blades fully closed.
Figure 22:
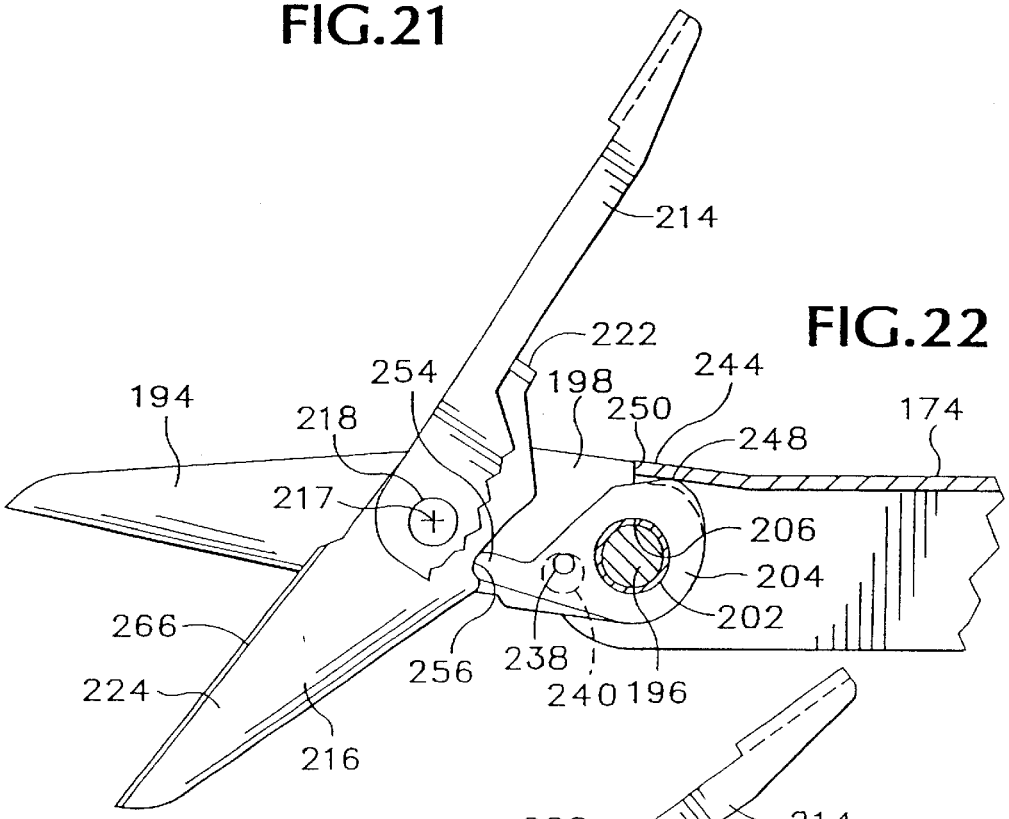
FIG. 22 is a view similar to FIG. 21, showing the scissors blades fully open.
Figure 23:
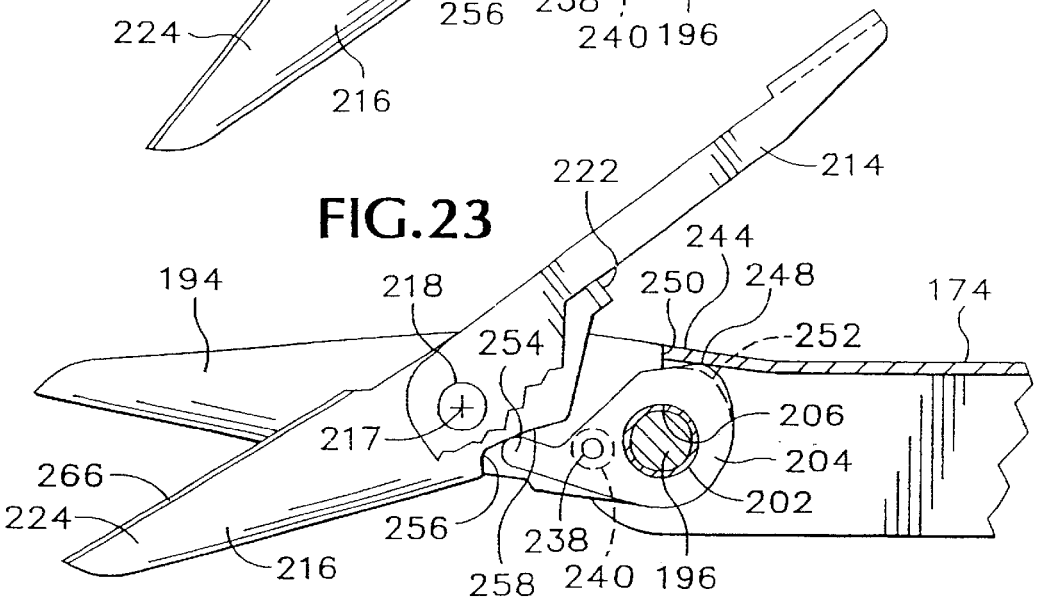
FIG. 23 is a view similar to FIG. 21, showing the scissors blades partially closed.

The cam surface 252 on the base portion 198 of the first blade 194, near the blade extension stop 250, is lower than the cam surface 248 of the rocker 204, so that the cam surface 248 presses against the spring 244 except when the blades 194, 216 are near their furthest open position as shown in FIG. 22. The spring 244, by pressing against the cam surface 248, urges the rocker 204 to rotate in a clockwise direction as shown in FIGS. 21–23. The rocker 204 is then free to move clockwise relative to the first blade 194 because of the freedom of the pin 238 to move within the hole 240 until a finger 254 on an outer end of the rocker 204 presses against the base portion 234 of the second blade 216. The rocker 204 thus urges the second blade 216 to move in a counterclockwise direction, opening the cutting portions 224 and 226 apart from each other toward an open position of the scissors blades. The ear 222 of the second blade 216 presses against the operating lever 214, carrying the operating lever 214 along with counterclockwise opening movement of the second blade 216.

When the scissors blades 194 and 216 reach their fully opened position, as shown in FIG. 22, a blade opening stop 256 defined on the base portion 242 encounters the finger 254 which prevents the second blade 216 from moving further in a counterclockwise, opening direction. With the blades 194 and 216 in their fully opened position the rocker 204 is in its furthest clockwise position, relative both to the base portion 198 of the first blade 194, and to the handle 174 and the spring 244. As the rocker 204 moves clockwise the shape of the cam 248 allows the spring 244 to return toward its relaxed position, and the outer end of the spring 244 slides down along the blade extension stop 250 on the base portion 198 of the first blade 194. The spring 244 thus continues to urge the rocker 204 in a clockwise direction and continues to urge the second blade 216 and the operating lever 214 toward the position shown in FIG. 22 until the scissors blades are nearly fully opened.

To use the scissors to cut an object, it is only necessary to push against the handle tab 230 of the operating lever 214, urging it toward the handle 174. This rotates the second blade 216 clockwise about the scissors pivot axis 217 and brings the cutting portions 224 and 226 closer together in a normal scissors cutting motion. As the cutting portions 224 and 226 approach each other a cam surface 258 of the base portion 242 pushes against the finger 254 on the outer end of the rocker 204, urging the rocker 204 counterclockwise about the tool pivot shaft 196, with respect to the base portion 198, thus moving the cam lobe 248 along the spring 244, raising the spring 244 along the blade extension stop 250 and storing energy in the spring 244 to open the cutting portion 224 and 226 apart from each other thereafter in preparation for a subsequent cutting stroke.

The cam surface 258 is preferably slightly concave, so that as the cutting portions 224 and 226 approach and reach a fully closed position the point of contact between the cam surface 258 against the finger 254 on the outer end of the rocker 204 is further from the scissors pivot axis 217 and closer to the tool pivot shaft 196 than when the scissors blades are in their fully opened position as shown in FIG. 22. As a result, the force of the spring 244 is transmitted through the rocker 204 to the second blade 216 with an increasing mechanical advantage tending to open the scissors blades apart from each other in order to avoid the possible problem of the blades sticking against each other in a fully closed position. The base portion 242 of the first blade 194 encounters the rocker 204 when the blades 194 and 216 reach the fully closed position, preventing them from passing beyond each other.

When use of the scissors has been completed, to fold the scissors for storage within the cavity 192 of the handle 174 it is necessary only to push against the back of the first blade 194, moving it in a counterclockwise direction with respect to the handle 174. Since the pin 238, engaged in the hole 240, links the rocker 204 with the first blade 194, moving the first blade 194 brings the rocker and its cam surface 248 similarly counterclockwise until the cam surface 248 and the base portion 198 of the first scissors blade 194 are clear from contact with the spring 244, after which the entire folding scissors 190 can easily be swung back to the position shown in FIG. 19. Thereafter, the operating lever 214 may be swung further counterclockwise until the folding scissors 190 is in the fully stowed position shown in FIGS. 15 and 18, where the base 198 and the rocker 204 are clear of the spring 244 so that the folding scissors 190 does not deflect the spring 244 from its relaxed position.

Figure 25:
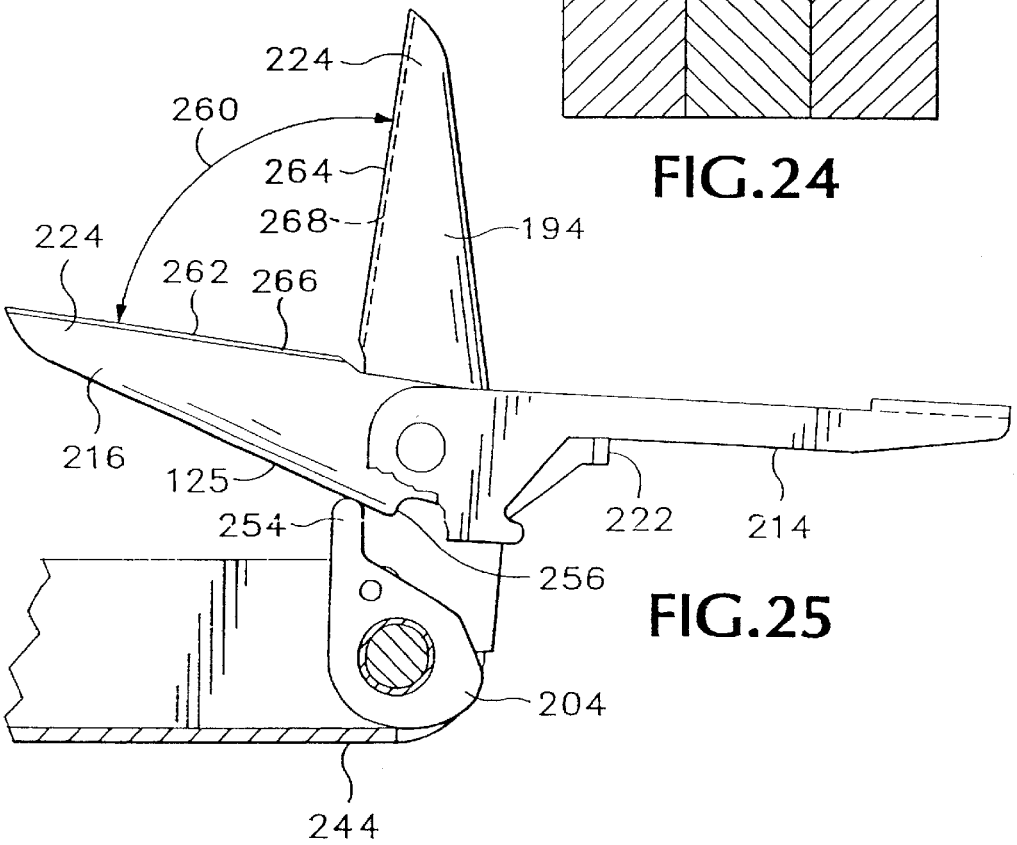
FIG. 25 is a view similar to that of FIG. 20, with the scissors blades in position for sharpening.

When it is necessary to sharpen the scissors blades 194 and 216 the first scissors blade can be placed in a position such as is shown in FIG. 25, and the second blade 216 can be moved to the position shown in FIG. 25 with respect to the first blade 194. Since the spring 244 is not in contact with either of the cam surfaces 248 and 252 the rocker 204 is free to rotate, as limited by the pin 238 and hole 240, so that the finger 254 moves beyond the blade opening stop 256 to the position shown in FIG. 25. This allows the second blade 216 to move to an open position giving an angle 260 of at least 90° between the cutting edges 262, 264 of the two blades, providing advantageous clearance for sharpening the cutting edges 262, 264.

Figure 26:
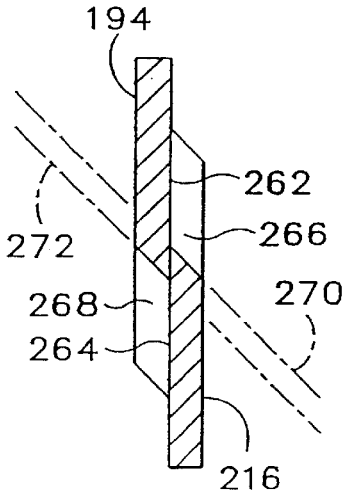
FIG. 26 is a sectional view taken along line 26—26 of FIG. 21.

The cutting edges 262, 264 are defined by a beveled surface 266 of the second scissors blade 216 and a similar beveled surface 268 on the first scissors blade 194. Each of the two beveled surfaces defines a respective plane 270, 272 (FIG. 26) and each particular scissors blade 194 or 216 is located completely on one side of the respective plane 270 or 272 defined by the beveled surface 266 or 268 of that scissors blade. As a result, no other part of either of the scissors blades 194 and 216 interferes with engaging the respective beveled surface 266 or 268 with a surface grinder to sharpen the respective cutting edge 262 or 264. The beveled surfaces 266, 268 are thus exposed for convenient grinding to sharpen the edges, both before assembly of the scissors 190 and, when the assembled scissors is placed in the position shown in FIG. 25, for resharpening after extended use.

It will be understood that, instead of the folding scissors 190, the tool 170 could also include folding pliers or similar tools (not shown) operating in a manner similar to that of the scissors 190 and including a pair of jaws pivoted with respect to each other about a jaw pivot axis defined by a fastener such as the rivet 218 and movable with respect to each other by the use of an operating lever similar to the operating lever 214. The jaws would include acting portions corresponding to the cutting portions 224, 226 of the scissors blades 194, 216, which would be urged apart from each other by the use of a rocker corresponding to the rocker 204 acting on one of the jaws or jawlike members of such a folding tool. The action of such a rocker, in response to the force of a spring such as the leaf spring 244, would urge the jaws to open ordinarily in opposition to jaw-closing pressure exerted by the user on the operating lever.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles; and (c) a first spring extending within said cavity of one of said handles and urging said tips of said jawlike members apart when said jawlike members are deployed with respect to said handles.

2. The folding tool of claim 1 wherein said first spring also urges said handles apart when said jawlike members are deployed with respect to said handles.

3. The folding tool of claim 1 including at least three additional springs.

4. The folding tool of claim 1 wherein one of said pair of handles has said first spring acting on a respective one of said pair of jawlike members and the other one of said pair of handles has another spring acting on the other one of said pair of jawlike members.

5. The folding tool of claim 1 wherein said first spring urges said jawlike members apart by acting upon one of said jawlike members.

6. The folding tool of claim 1 including an additional spring defining at least a portion of said cavity of one of said handles.

7. The folding tool of claim 1 wherein each of said handles includes a pair of opposing spaced-apart side walls, at least one of said handles further including a tool bit foldable with respect to said handle between an extended position and a stowed position between said side walls.

8. The folding tool of claim 7 wherein each of said handles includes a tool bit foldable with respect to said respective handle between an extended position and a stowed position between said respective side walls.

9. The folding tool of claim 7 wherein said at least one of said handles is elongate and has first and second ends, and wherein a respective one of said jawlike members is attached to said handle at said first end and said tool bit is attached to said handle at said second end.

10. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; and (d) an additional spring retaining said handles together when said tool is in said folded configuration.

11. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; and (d) at least one additional spring operatively associated with at least one of said handles and acting on said base of at least one said jawlike member to retain said jawlike member in said deployed position.

12. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; and (d) at least one additional spring operatively associated with at least one of said handles and acting on said base of at least one of said jawlike members to retain said at least one of said jawlike members in said cavity when said tool is in said folded configuration.

13. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; and (d) at least three additional springs, wherein all three of said additional springs act on said jawlike members.

14. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles, said first spring being attached to one of said pair of handles; and (d) at least one additional spring attached to the other one of said pair of handles.

15. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; wherein said first spring urges said jawlike members apart by acting upon said jawlike members; and (d) a rocker interposed between said first spring and one of said jawlike members.

16. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles; and (c) a first spring urging said tips of said jawlike members apart when said jawlike members are deployed with respect to said handles, and wherein said first spring urges said jawlike members apart by acting upon said jawlike members, and wherein a first one of said pair of handles includes said first spring and the other one of said pair of handles includes an additional spring, and wherein each of said first spring and said additional spring defines at least a portion of said cavity defined by a respective one of said pair of handles.

17. A folding tool comprising:

(a) a pair of jawlike members, each jawlike member including a tip and an opposite base said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; and (d) a second spring urging said tips of said jawlike members apart when said jawlike members are deployed with respect to said handles.

18. A folding tool comprising:

(a) a pair of jawlike members, each jawlike member including a tip and an opposite base, said jawlike members being pivotally interconnected with each other by a jaw pivot joint located between said tip and said base of each jawlike member;

(b) pair of handles, each of said handles defining a cavity capable of receiving one of said jawlike members, said handles respectively being pivotally connected to said bases of respective ones of said jawlike members whereby said tool may be configured with said jawlike members deployed with respect to said handles or in a folded configuration with said jawlike members received respectively in said cavities defined by said handles; and (c) a first spring urging said tips of said jawlike members apart when said jawlike members are deployed with respect to said handles, and wherein said first spring urges said handles together when said tool is in said folded configuration with said jawlike members received in said cavities.

19. A folding tool comprising:

(a) a pair of jawlike members, each jawlike member including a tip and an opposite base, said jawlike members being pivotally interconnected with each other by a jaw pivot joint located between said tip and said base of each jawlike member;

(b) a pair of handles, each of said handles defining a cavity capable of receiving one of said jawlike members, said handles respectively being pivotally connected to said bases of said respective jawlike members whereby said tool may be configured with said jawlike members deployed with respect to said handles or in a folded configuration with said jawlike members received respectively in said cavities defined by said handles;

(c) a first spring urging said tips of said jawlike members apart when said jawlike members are deployed with respect to said handles; wherein said first spring urges said jawlike members apart by acting upon said jawlike members; and wherein said first spring defines a portion of said cavity in at least a first one of said pair of handles and acts upon said jawlike member to which the other of said pair of handles is pivotally connected, through a rocker connected to the jawlike member to which said first one of said pair of handles is connected.

20. A folding tool including a pair of jawlike members, comprising:

(a) a pair of handles each defining a cavity;

(b) a pair of jawlike members interconnected with each other at a jaw pivot joint, each of said jawlike members having a base portion interconnected movably with a respective one of said handles, and each of said jawlike members being movable about a respective handle pivot axis, between a deployed position and a stowed position at least partially within said cavity defined by said respective one of said handles; and (c) a jaw spring located in one of said handles and acting on said base portion of a respective one of said jawlike members that is interconnected with said one of said handles, thereby holding said respective one of said jawlike members extended with respect to said one of said handles when said respective one of jawlike members is in said deployed position, but urging said respective one of said jawlike members into said cavity when said respective one of said jawlike members is in said stowed position, said jaw spring thereby retaining said handles adjacent each other when said jawlike members are both in said respective stowed positions.

21. The folding tool of claim 20 including at least one additional spring acting on at least one of said jawlike members and urging said jawlike members to pivot about said jaw pivot joint with respect to each other in a jaw opening direction when said jawlike members are in their respective deployed positions.

22. The folding tool of claim 20 also including a respective jaw spring in the other one of said pair of handles acting on the base of the other one of said pair of jawlike members, said jaw springs thereby holding both of said jawlike members stationary with respect to said handles when said jawlike members are in their deployed positions but retaining said jawlike members in said cavities defined by said handles when said jawlike members are in their respective stowed positions, thereby retaining said folding tool into a folded configuration thereof.

23. The folding tool of claim 20 wherein each of said handles includes a sheet metal member in two planes substantially perpendicular to each other, forming at least part of said channel defining said cavity.

24. A folding tool including a pair of jawlike members, comprising:

(a) a pair of handles;

(b) a pair of jawlike members interconnected with each other by a jaw pivot joint, each of said jawlike members being interconnected with a respective one of said handles and being movable about a respective handle pivot axis, between a deployed position and a stowed position with respect to said respective one of said handles;

(c) a respective jaw spring operatively associated with each of said handles and acting on a respective one of said jawlike members, thereby urging said jawlike members to remain in said deployed position thereof when said jawlike members are in said deployed position, but urging said jawlike members toward said stowed position thereof and thereby urging said folding tool toward a folded configuration thereof when both of said jawlike members are in said stowed positions thereof.

25. The folding tool of claim 24 wherein each of said jaw springs urges a respective one of said jawlike members toward said deployed position when said respective one of said jawlike members is near said deployed position.

26. The folding tool of claim 24 wherein each of said jaw springs urges a respective one of said jawlike members toward said stowed position when said respective one of said jawlike members is near said stowed position.

27. The folding tool of claim 24 wherein said jaw springs are attached to said respective handles.

28. The folding tool of claim 24 wherein said jaw springs are not integral with the material of said handles.

* * * * *